US009056759B2

(12) United States Patent
Hourmand et al.

(10) Patent No.: US 9,056,759 B2
(45) Date of Patent: Jun. 16, 2015

(54) BEVERAGE DISPENSING SYSTEM

(71) Applicant: Bacardi & Company Ltd., Vaduz (LI)

(72) Inventors: Yannick Hourmand, Cambridge (GB); Didier Brunet, Paris (FR)

(73) Assignee: Bacardi & Company Ltd., Vaduz (LI)

( * ) Notice: Subject to any disclaimer, the term of this patent is extended or adjusted under 35 U.S.C. 154(b) by 17 days.

(21) Appl. No.: 13/686,790

(22) Filed: Nov. 27, 2012

(65) Prior Publication Data

US 2014/0144927 A1 May 29, 2014

(51) Int. Cl.

| | |
|---|---|
| ***B65D 35/22*** | (2006.01) |
| ***B67D 3/00*** | (2006.01) |
| ***B67D 1/14*** | (2006.01) |
| ***B67D 1/00*** | (2006.01) |
| ***B67D 1/06*** | (2006.01) |
| ***B67D 1/08*** | (2006.01) |

(52) U.S. Cl.

CPC ..... *B67D 3/0016* (2013.01); *B67D 1/1405* (2013.01); *B67D 1/0021* (2013.01); *B67D 1/06* (2013.01); *B67D 1/0842* (2013.01); *B67D 2001/0827* (2013.01)

(58) Field of Classification Search

CPC ..... B56D 81/325; B65D 83/68
USPC ..... 222/94, 129, 506, 139–142, 137, 222/145.5–145.7, 511, 145.1, 544, 135, 132
See application file for complete search history.

(56) References Cited

U.S. PATENT DOCUMENTS

| | | | | |
|---|---|---|---|---|
| 2,921,605 | A | | 1/1960 | Booth et al. |
| 3,088,490 | A | | 5/1963 | Rockwood et al. |
| 3,167,090 | A | | 1/1965 | Booth et al. |
| 3,194,440 | A | * | 7/1965 | Watson, Jr. ..... 222/93 |
| 3,435,990 | A | * | 4/1969 | Pike, Jr. ..... 222/1 |
| 3,591,055 | A | * | 7/1971 | Norton ..... 222/145.5 |
| 3,655,097 | A | | 4/1972 | Booth et al. |
| 4,741,355 | A | | 5/1988 | Credle |
| 5,186,359 | A | * | 2/1993 | Brown et al. ..... 222/1 |
| 5,425,583 | A | | 6/1995 | Wild |
| 5,673,817 | A | * | 10/1997 | Mullen et al. ..... 222/94 |
| 5,697,526 | A | * | 12/1997 | Lee ..... 222/113 |
| 5,799,833 | A | * | 9/1998 | Green et al. ..... 222/135 |
| 6,450,369 | B1 | | 9/2002 | Heyes |

(Continued)

FOREIGN PATENT DOCUMENTS

| | | |
|---|---|---|
| EP | 0749358 | 12/1996 |
| EP | 1170653 | 9/2002 |
| WO | 9530856 | 11/1995 |

*Primary Examiner* — Kevin P Shaver
*Assistant Examiner* — Robert Nichols, II
(74) *Attorney, Agent, or Firm* — Loeb & Loeb LLP

(57) ABSTRACT

The disclosure relates to a system for simultaneously dispensing liquids from multiple sources, wherein the liquids are released through a single spout and are mixed together during the dispensing process. The disclosure further discloses an adaptor that has a dispensing aperture, a body, and first and second members that actuate the spouts substantially simultaneously to allow fluid flow between the first and second liquid sources and the first and second tap spouts through the adaptor body and out the dispensing aperture, which may have a spout. The invention also relates to a method for simultaneous dispensing and mixing of liquids. The liquids may have substantially the same or substantially different viscosities and may be mixed in equal or different volumes. The invention has particular applicability to bag-in-box systems.

13 Claims, 20 Drawing Sheets

(56) References Cited

U.S. PATENT DOCUMENTS 6,871,679 B2 3/2005 Last
7,156,359 B2 1/2007 Dittmer
8,087,544 B2 1/2012 Elsom
2004/0069803 A1* 4/2004 Leray et al. ..... 222/145.1

* cited by examiner

BEVERAGE DISPENSING SYSTEM

FIELD OF THE INVENTION

The invention relates to a system for simultaneously dispensing and mixing liquids through a single spout from multiple sources, such as a plurality of pouches, which may be contained in a box (i.e. a bag-in-box package).

BACKGROUND OF THE INVENTION

Delivery of mixed liquids from two or more sources is known. For instance, this approach to mixing liquids immediately prior to use has been used to ensure efficacy of the post-mixed cleaning product. Those cleaning products are often sold in portable containers to facilitate portability and dispensing in a variety of locations. The portable containers may comprise a box with two or more pouches disposed therein.

The mixing of liquids immediately prior to use is not limited to cleaning products. For instance, soda fountains that prepare soft drinks (and other beverages) by mixing a flavor syrup with either plain or carbonated water are well-known. Some dispensers allow selective dispensing of either one or both of the fluids simultaneously. In some dispensers, the valves may be regulated by the end user. In others, the regulation is pre-established.

These beverage dispensers may include one or more inlets each connected to a fluid source. Such dispensers may include a pair of lever arms attached to a respective one of the valves that extend outwardly from the inlets so as to dispense fluid when the respective lever arms are actuated. Some of these assemblies are electrically operated. Others are mechanical. Valve assemblies can be used in either a gravity or a pressure dispenser, and dispense liquids at either a standard flow rate or a fast flow rate. (See, e.g., U.S. Pat. Nos. 2,921,605; 3,088,490; 3,167,090; 3,655,097; and 4,741,355).

In many soft drink dispensers, a mixing spout and chamber allows for mixing and dispensing the fluids. In some cases, separate levers can be used to enable selective individual operation of the valves to allow either fluid to be dispensed.

It is also known in the beverage arts to mix beverage concentrates and a diluent in predetermined proportions. For example, drink dispensers for fruit juice beverages prepare the beverages by mixing a concentrated product (e.g. orange juice concentrate, apple juice concentrate, soda syrups, etc.), with a desirable proportion of water to provide a consumable drink product. The ratio of water to concentrate typically range from 2:1 (i.e. two parts water to one part concentrate) to 10:1. Due to differences between concentrates problems may arise in maintaining proper mixing ratios. Further problems arise from pulp and the relatively high and temperature-dependent viscosity of fruit juice concentrates, which make it difficult to directly measure the flow of such concentrate in the preparation of a drink, in turn making it difficult to control the ratio of water to concentrate. In an effort to achieve the desired ratio of water to concentrate, most fruit juice dispensers rely on a flow of a concentrate delivered by a metering pump (e.g. a peristaltic pump) operated at a pre-determined constant speed into a constant flow of water to provide the desired water to concentrate ratio. Such systems provide a beverage dispensing system in which first and second beverage elements are brought together in a mixing chamber in a predetermined ratio that is maintained constant by regulating flow of at least one of the elements.

Some standard beverage valves require manual adjustment of water-to-concentrate ratio and then readjustment based on seasonal changes in temperature. In such dispensers, trained technicians must adjust carbonators during summer months when the water temperature is higher. After adjusting the carbonator, the technician must then readjust the water-to-concentrate ratio of each valve, which can take a significant amount of time and result in significant cost. Further, such valves require periodic cleaning. (See, e.g., U.S. Pat. Nos. 8,087,544; 6,450,369; and 7,156,359). Accordingly, there is a need in the industry for a beverage dispenser that is inexpensive and easy-to-use.

One new approach to home beverage dispensing is the use of bag-in-box (BiB) packaging. Bag-in-box packages are inexpensive and easy-to-use. As such, bag-in-box packaging has already been used to store, transport, and dispense various liquids for human consumption, such as juices, wines, and edible oils. In order to dispense the substance from the bag, a connection must be made between fluid in the bag and the outside world. Usually this is done with a tap. The tap is usually a two-port valve with valve member and an actuator that opens and closes the valve member to control fluid flowing from the bag to the tap outlet or spout. Because these taps rely in some part on gravity to operate, the tap outlet tap has generally been oriented so that the liquid flows out of the tap in a downward orientation. Taps provide the added benefit of minimizing the potential contamination of the interior of the bag and the liquid contained therein.

Bag-in-box packaging for residential use has been gaining in popularity because BiB packaging can maintain the quality of the substance contained within the bags because they remain substantially hermetically sealed from the outside environment.

Bag-in-box packaging has also long been used in soft drink dispensing systems for the syrup bases. In these commercial systems, a plurality of BiB packages are used (one for each drink type). In these commercial systems, each BiB package has a valve that is connected to the soft drink dispenser, which draws the syrups out of the bag through the use of pumps into the dispenser where it is mixed with still or carbonated water. Bag-in-box packaging has also been used for liquid cleaners.

In some instances, bag-in-box packages contain more than one bag. Usually separate bags are used in applications where the mixing of "reactive" components could cause the ultimate mixture to lose its efficacy. In packages with multiple bags, it is known to provide separate taps for each bag in the package (See, e.g., U.S. Pat. Nos. 6,871,679 and 5,425,583, European Patent Application Nos. 1 170 653 and 0 749 358, and PCT Patent Application Publication No. WO 95/30856.). These prior approaches contemplate the mixing of the separate liquids in the container to which the fluids are separately dispensed.

It would be desirable to have a bag-in-box system that mixes two or more liquids while dispensing them from a single spout. Such a system would be particularly useful for preparing beverages that require two or more components, such as a mojito or pina colada.

BRIEF SUMMARY OF THE INVENTION

The disclosed subject matter relates to a system for dispensing a liquid sourced from a plurality of liquid sources comprising a first tap operably connected to a first one of the plurality of liquid sources, the first tap having a first tap spout, a first valve member biased closed so as to prevent fluid flow from the first liquid source to the first tap spout unless under a counter-biasing force, and a first actuator operably associated with the first valve member to apply the counter-biasing force. The system further comprises a second tap operably connected to a second one of the plurality of liquid sources, the second tap having a second tap spout, a second valve member biased closed so as to prevent fluid flow from the second liquid source to the second tap spout unless under a counter-biasing force, and a second actuator operably associated with the second valve member to apply the counter-biasing force; and an adaptor having a dispensing spout and a body to communicate fluid between the dispensing spout and each of the first and second tap spouts.

The disclosed subject matter further relates to an adaptor for operably associating first and second taps respectively connected to first and second liquid sources, the first tap having a first tap spout, a first valve member biased closed so as to prevent fluid flow from the first liquid source to the first tap spout unless under a counter-biasing force, and a first actuator operably associated with the first valve member to apply the counter-biasing force, the second tap having a second tap spout, a second valve member biased closed so as to prevent fluid flow from the second liquid source to the second tap spout unless under a counter-biasing force, and a second actuator operably associated with the second valve member to apply the counter-biasing force. The adaptor comprises a dispensing aperture and a body in fluid communication with each of the first and second tap spouts and the dispensing aperture wherein the liquids from the first and second liquid sources are at least partially mixed together in the body.

The disclosed subject matter additionally relates to a system for dispensing a liquid comprising a container; a first liquid bag disposed within the container, the first liquid bag storing a first liquid; and a second liquid bag disposed within the container, the second liquid bag storing a second liquid. The system further comprises a first tap operably connected to a first one of the plurality of liquid sources, the first tap having a first tap spout, a first valve member biased closed so as to prevent fluid flow from the first liquid source to the first tap spout unless under a counter-biasing force, and a first actuator operably associated with the first valve member to apply the counter-biasing force; a second tap operably connected to a second one of the plurality of liquid sources, the second tap having a second tap spout, a second valve member biased closed so as to prevent fluid flow from the second liquid source to the second tap spout unless under a counter-biasing force, and a second actuator operably associated with the second valve member to apply the counter-biasing force; and an adaptor having a dispensing aperture and a body in fluid communication with each of the first and second tap spouts and the dispensing aperture wherein the liquids from the first and second liquid bags are at least partially mixed together in the body.

The disclosed subject matter also relates to a system for dispensing a liquid sourced from a plurality of liquid sources comprising a first tap operably connected to a first one of the plurality of liquid sources, the first tap having a first tap spout, a first valve member biased closed so as to prevent fluid flow from the first liquid source to the first tap spout unless under a counter-biasing force, and a first actuator operably associated with the first valve member to apply the counter-biasing force and a second tap operably connected to a second one of the plurality of liquid sources, the second tap having a second tap spout, a second valve member biased closed so as to prevent fluid flow from the second liquid source to the second tap spout unless under a counter-biasing force, and a second actuator operably associated with the second valve member to apply the counter-biasing force. The system also comprises an adaptor having a dispensing spout; a body having a first chamber in fluid communication with the first tap spout, the body further having a second chamber in fluid communication with the second tap spout, the first and second chambers in fluid communication with the dispensing spout; and a first member having a front flange and an actuator flange, the actuator flange being disposed in an abutting relationship with the first and second actuators. The system further comprises a second member mounted over the first member, such that when the front flange of the first member is pinched toward the second member the actuator flange of the first member counter-biases the first and second actuators with the force necessary to allow fluid flow from the first and second liquid sources through the first and second tap spouts and into the first and second chambers, respectively, and a stem having an internal fluid channel with an exit at an end of the internal fluid channel and first and second apertures spaced-apart from the end of the internal fluid channel and operably connected thereto, the stem disposed in the dispensing spout, the stem being rigidly connected to the first member such that the stem moves up and down in the dispensing spout such that the first and second apertures are only in fluid registration with the first and second chambers via the dispensing spout when the first member is at rest.

The subject technology further relates to a method of preparing a mixed drink comprising acquiring a container, the container having first and second liquid bags disposed therein, the first liquid bag storing a first liquid and the second liquid bag storing a second liquid, a first tap operably connected to the first liquid bag, the first tap having a first tap spout, a first actuator, and a first valve member that prevents fluid flow from the first liquid bag to the first tap spout unless the first actuator is biased by a linear force, a second tap operably connected to the second liquid bag, the second tap having a second tap spout, a second actuator, and a second valve member that prevents fluid flow from the second liquid bag to the second tap spout unless the second actuator is biased by a linear force; installing an adaptor over the first and second taps, the adaptor having a dispensing spout; a body in fluid communication with each of the first and second tap spouts and the dispensing spout; and receiving the mixed liquids into a vessel.

Other systems, methods, features, and advantages of the present invention will be or will become apparent to one with skill in the art upon examination of the following figures and detailed description. All such additional systems, methods, features, and advantages are included within this description, are within the scope of the invention, and are protected by the accompanying claims. Accordingly, the present invention is not restricted except in light of the attached claims and their equivalents.

BRIEF DESCRIPTION OF THE FIGURES

For a better understanding of the present disclosure, non-limiting and non-exhaustive embodiments are described in reference to the following drawings. In the drawings, like reference numerals refer to like parts through all the various figures unless otherwise specified.

DETAILED DESCRIPTION OF THE INVENTION

As described above, conventional liquid delivery from standard bag-in-a-box dispensers rely upon a single tap, which delivers the single liquid into a receptacle, such as a drinking glass. The present specification describes a new system, adaptor, and method for simultaneously dispensing liquids from multiple pouches and mixing those liquids as they are being dispensed, for instance, into a receptacle. The multiple pouches used in this new system and method (or with the adaptor) may be contained together in a single box or on a tray or separately, with or without box, to further protect the pouch or bag that stores the liquid. In situations where no box or tray is used the product may be more economical and environmentally-friendly to produce.

Figure 1:
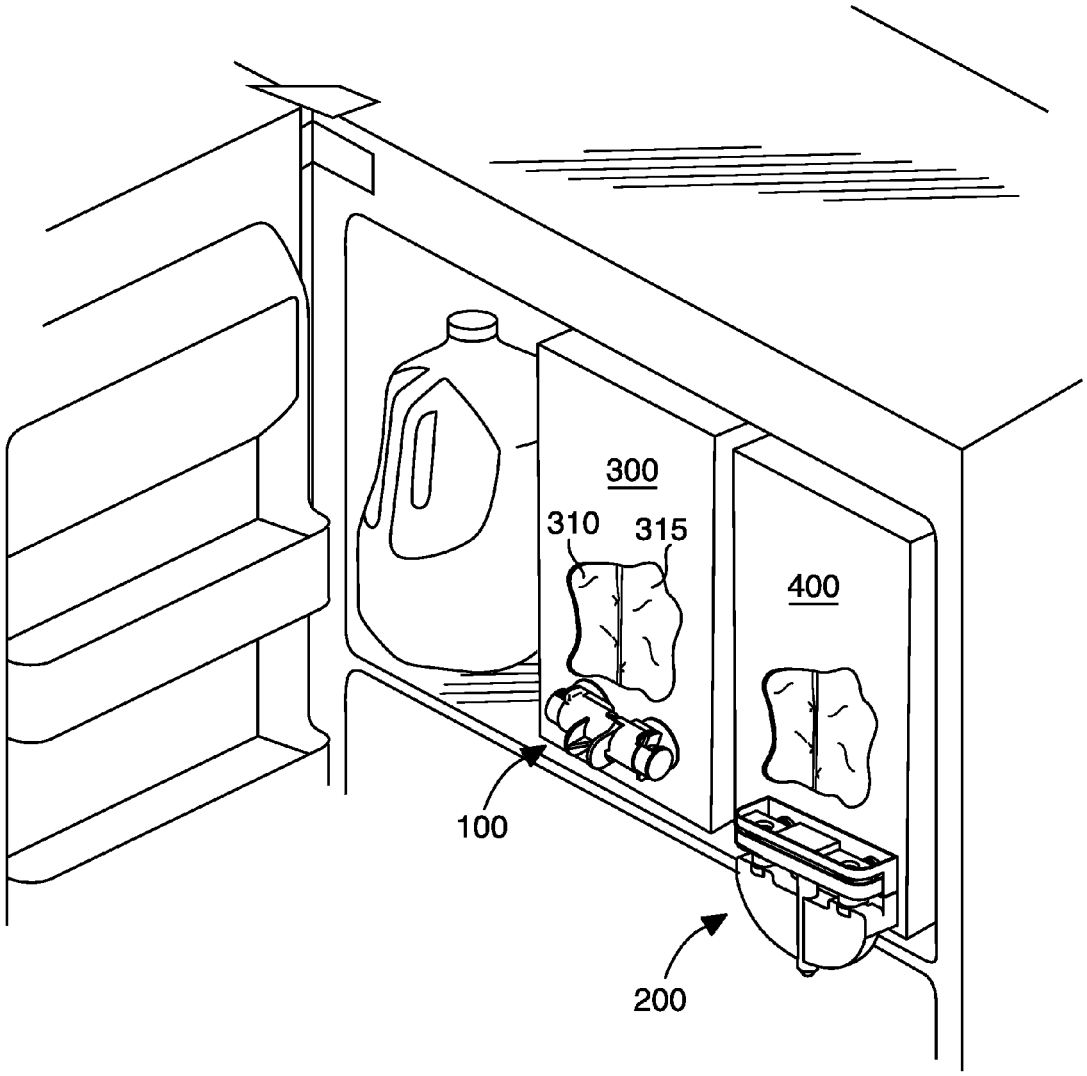
FIG. 1 illustrates two embodiments of the present invention in use on a shelf in a residential refrigerator.

The products are generally illustrated in FIG. 1 in use on a shelf in a residential refrigerator. However, as would be understood by those of skill in the art having the present specification, figures, and claims before them, the products may be used in commercial settings (e.g. bars, cafes, and restaurants) and even outdoors (such as at a picnic or on a camping trip). As will be described further below, the container 300 may be used to dispense a mixed beverage where two liquid drink components are mixed in a 1:1 ratio. However, as would be understood by those of ordinary skill in the art having the present specification, drawings, and claims before them, if the components have sufficiently different viscosities then the mixing may not take place in a 1:1 ratio. The container 300 has an adaptor 100 that attaches to a plurality (e.g., two) single taps with each tap being operably attached to a bag within the container. As depicted, container 300 has single taps that are oriented within the adaptor 100 such that their outlets are oriented so as to discharge liquid toward one another in a substantially longitudinal orientation.

The container 400 is also illustrated in FIG. 1. Container 400 has an adaptor 200 that dispenses beverages where the two liquid drinks components may have a desired ratio between the liquids that is not 1:1 or where the components may have significantly different viscosities where a 1:1 mixing ratio of the liquids may still be desired. It would be understood by those of ordinary skill in the art having the present specification, drawings and claims before them that the present invention may be used in association with a variety liquids. For example, other types of consumable products, such as sauces and salad dressings may be dispensed with this system. In another example, multi-component cleaning products especially those products that may benefit from mixing immediately prior to use may be dispensed by the invention of the present system.

Both adaptors 100 and 200 can be made of a wide variety of materials, including, but not limited to, plastic, metal, and glass. Both illustrative adaptors can be attached to the plurality of taps by snapping the elements of the adaptors together over the taps. The connection between the elements can also be made by any sort of friction fit. In this manner, it is contemplated that the adaptors 100 and 200 would be easy to install and subsequently remove from the taps of a container. In this manner, it is contemplated that the consumer could remove the adaptor from the container for cleaning by hand or in an automatic dishwasher.

Furthermore, it is contemplated that the adaptors 100 and 200 can be reused with subsequently purchased containers that are designed to work with the adaptors. In other words, the containers could be sold without an adaptor to consumers who already have an adaptor. Such an approach leads to less waste and may be used to keep the costs of using the present system lower over time. In this manner, once a consumer acquires one or both of adaptors 100 and 200 they may be more likely to continue using the present system.

It is alternatively contemplated that the connection between the taps and the adaptors may be permanent. Even with a permanent connection, it is contemplated that the bags within the container could be refilled for later uses. It is primarily contemplated that the pouches/containers will be intended for single use and thus the adaptors 100 and 200 will be disposed of with their associated container once the liquids have been used.

The pouches or bags may be made of any conventional materials used for storing liquids. For example, the bags may be made of a single- or multiple-ply plastic sheeting, foil, metalized plastic, etc. The bags may be filled with the desired liquids and sealed. Since contamination of the liquids should preferably be avoided, the bags should be able to undergo some type of sterilization procedure, either before or after filling. Consequently, the material for the bags may be selected to withstand a sterilization procedure, which may be a heat or chemical sterilization.

Figure 1A:
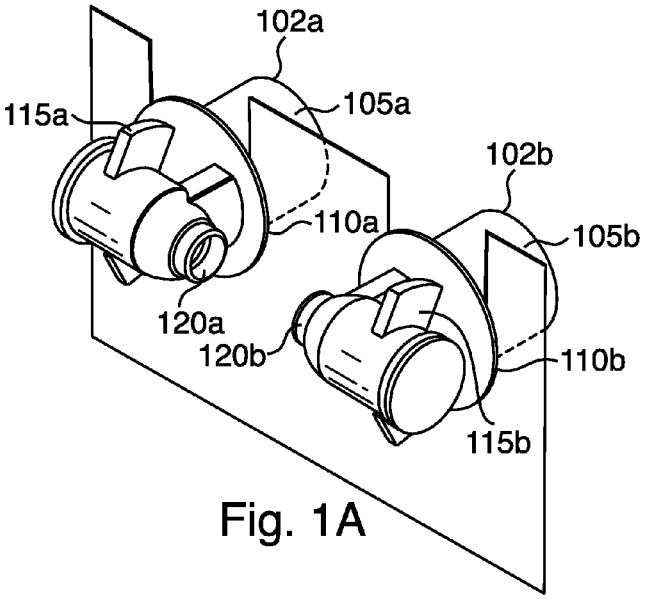
FIGS. 1A-1E illustrate one potential adaptor device for simultaneously dispensing a plurality of liquids from a plurality of liquid sources.

FIG. 1A illustrates two single taps 102*a* and 102*b* in a first inventive orientation. Each tap 102 operably attaches to a bag or pouch (not shown) via port 105*a*, 105*b*, respectively, in a manner that is already well-known in the art. However, as illustrated in FIG. 1A, unlike the prior art uses of taps, the taps 102 may be attached to their respective bags such that they are oriented at 90 degrees from the standard tap orientation so that the spigots 120*a* and 120*b* are facing each other. In other words, rather than the configuration commonly seen in the prior art where the spigots 120 would be facing downward (so that the liquids would be dispensed with the assistance of gravity directly into a receptacle) in the present invention, the first and second tap spouts are preferably oriented so as to discharge liquid toward one another in a substantially longitudinal orientation. This lateral orientation facilitates mixing in adaptor 100 and also allows the design of adaptor 100 to be more physically compact. A similar lateral orientation that may not take advantage of the potential compactness of facing spouts is shown in FIG. 1N where the tap spouts are still oriented so as to discharge liquid in a substantially longitudinal orientation however, they face apart necessitating a more sophisticated body that captures the outflow of both taps and redirects that flow back together for at least partial mixing prior to dispensing.

As depicted in the figures, the taps 102 may each have a skirt 110 that stabilize the taps 102 and maintain integrity of the bags after the taps 102 have been attached. Each tap 102 has a spout and a valve member (not shown) that is biased closed so as to prevent fluid flow from the associated liquid source to the tap spout. The taps 102 may also have actuator protrusions 115, which, when actuated by pressure from a user, opens a channel, allowing the liquid from the associated bag to be dispensed through the tap. Alternatively, as shown in FIG. 1M, taps 102 may alternatively have a push-button actuator disposed in the top of the tap housing that counter-biases the valve member open when pressed.

Figure 1B:
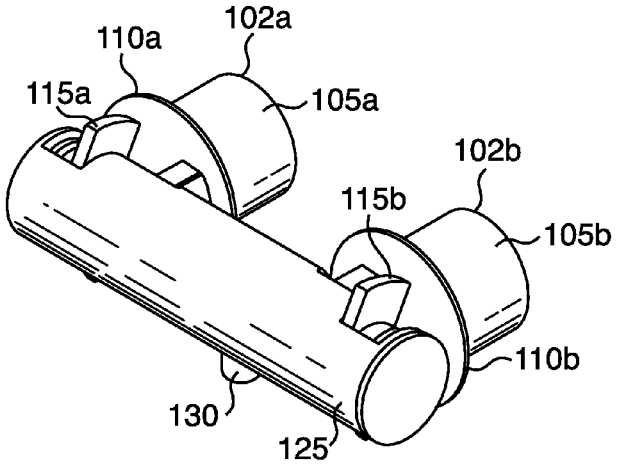

FIG. 1B illustrates body 125 of adaptor 100. The body 125 removably attaches to the taps 102*a* and 102*b* when they are laterally oriented in the manner shown in FIG. 1A. Body 125 is preferably cylindrical and may be made of a wide variety of materials, including, but not limited to, plastic, metal, and glass. When body 125 is operably attached to both of the taps 102, any liquid dispensed via the taps 102 from the bags flow into the interior of the body 125. The body 125 is configured such that the actuator protrusions 115 of both taps 102 extend outward from the body 125. The body 125 has a dispensing aperture 130, through which the liquids from both bags are dispensed as a single flow of liquid that may be at least partially mixed. In the depicted embodiment, the dispensing aperture may further have a dispensing spout that may form a substantially T-shape with the body 125. It is contemplated that the dispensing aperture may be a simple opening in the body to allow the liquids to flow out. The body 125 may further act as a frame positioned around the first and second taps to substantially preclude relative movement of the taps when a counter-biasing force is being mechanically applied to the taps as will be further discussed hereinbelow.

Figure 1E:
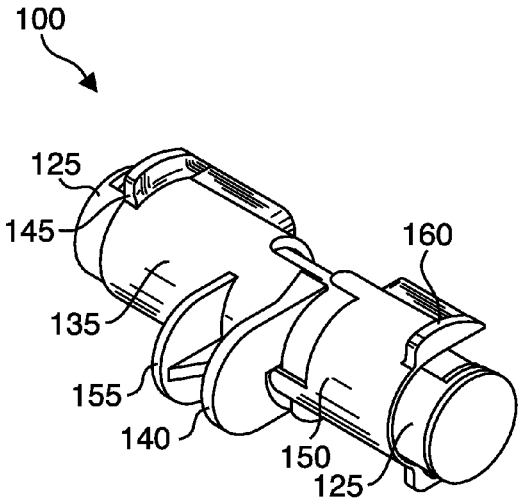
Figure 1C:
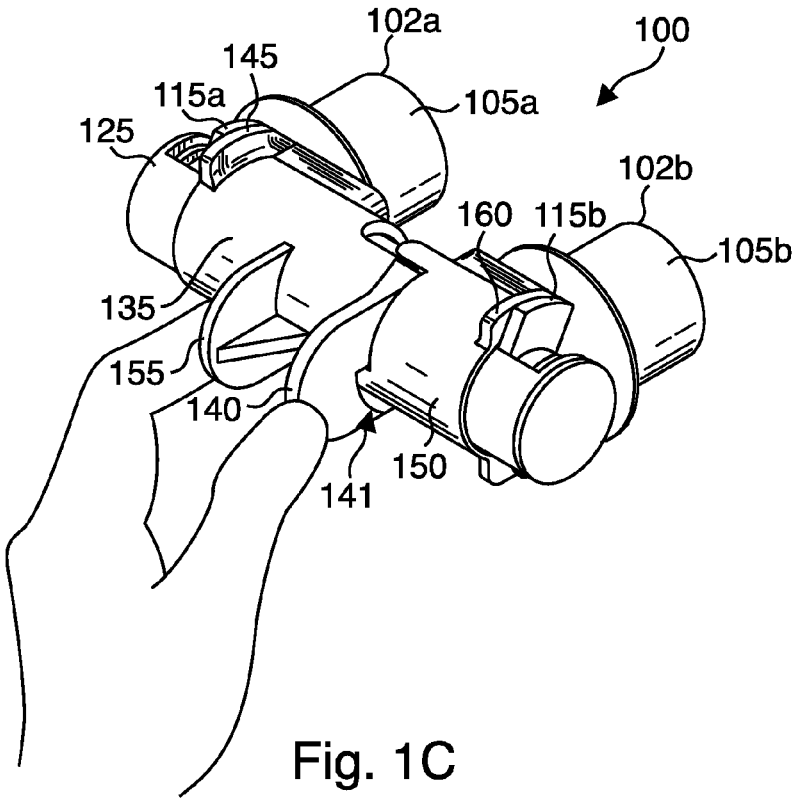

FIG. 1E illustrates a first member 135 and a second member 150 both slidably mounted over the body 125 (without depicting the taps to avoid obscuring the contours of the adaptor). However, as should be understood by those of ordinary skill in the art having the present specification and claims before them, the first and second members would be removably attached to the body 125 only after the body 125 is placed into fluid communication with the first and second tap spouts as illustrated in FIG. 1C. The figures show that the second member 150 is snapped onto the body 125 and then first member 135 is snapped over second member 150 and the body 125. (It is contemplated that the first and second members could be permanently attached the body 125, but such approach is not preferred because it may make cleaning the adaptor 100 more difficult.)

The first member 135 acts as an extension of the actuator 115*a* on the tap 102*a* and causes tap 102*a* to dispense liquid from the source operably associated with that tap. The first member 135 has a front flange 140 and a actuator flange 145, the actuator flange being disposed in an abutting relationship with the actuator 115*a* of the tap 102*a*.

The second member 150 acts as an extension of the actuator 115*b* on the tap 102*b* and causes that tap 102*b* to dispense liquid from the source operably associated with that tap. The second member 150 has a front flange 155 and a actuator flange 160, the actuator flange 160 being disposed in an abutting relationship with the actuator 115*b* of the tap 102*b*.

Figure 1D:
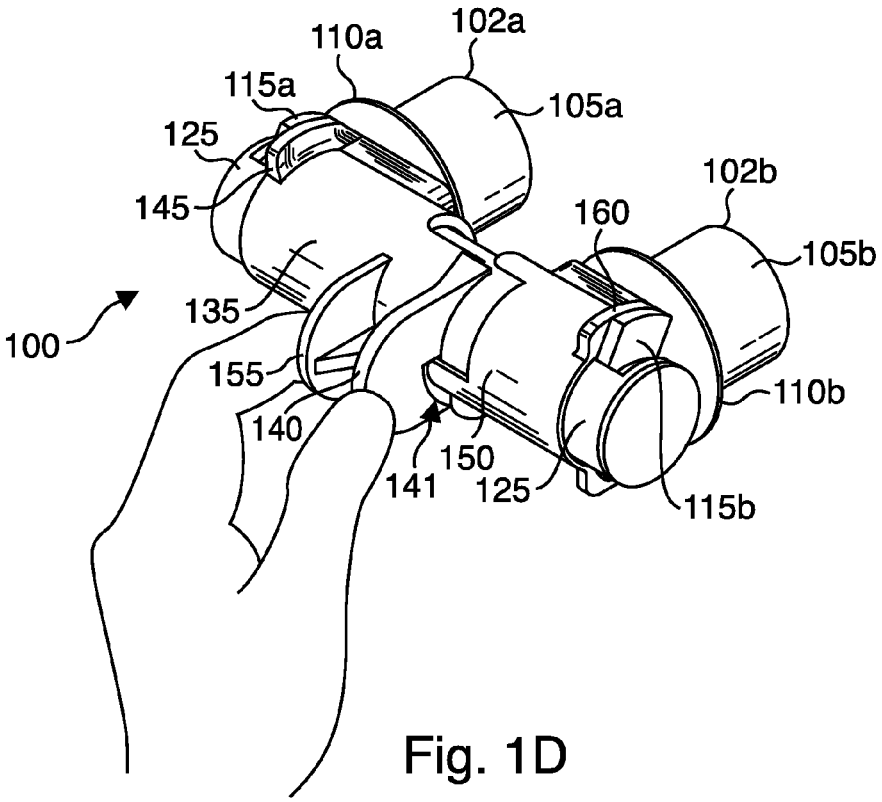

As shown in FIGS. 1C and 1D, the front flange 140 has a slot 141 to accommodate a portion of the second member 150 allowing the second member to slide relative to the first member. In this manner, when the front flanges 140 and 155 are pinched together by a user with their fingers (as illustrated by comparing FIG. 1C to FIG. 1D) the actuator flanges 145 and 160 slide outward biasing the actuators 115*a* and 115*b*, respectively, with the linear force necessary to allow fluid flow between the first and second liquid sources and the first and second tap spouts 120*a* and 120*b* (see FIG. 1A) into the body 125 and out through the dispensing aperture 130, mixing the liquids as they are dispensed. The first and second members can be made of a wide variety of materials, including, but not limited to, plastic, metal, and glass.

As would be understood by those of ordinary skill in the art having the present specification, drawings, and claims before them that the translation of human force into the counter-biasing force necessary to open the valve members of the first and second taps substantially simultaneously and with similar pressure may be achieved using a wide variety of means for mechanically applying a counter-biasing force to the first and second taps. Many example means are illustrated in FIGS. 1F-1O and will be described here to provide various illustrations of the technical breadth of the present invention.

Figure 1F:
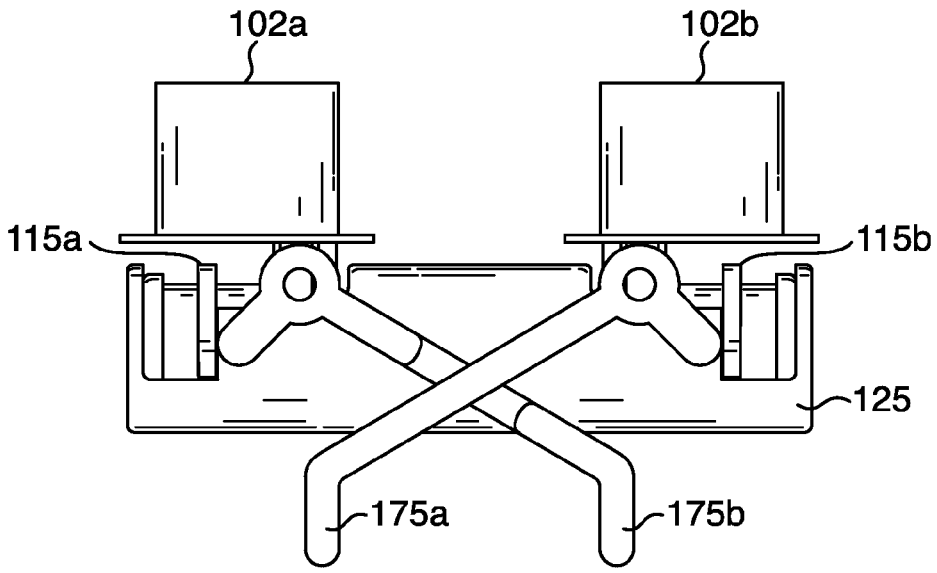
FIGS. 1F-1O illustrate other potential embodiments of adaptors for simultaneously dispensing a plurality of liquids from a plurality of liquid sources.
Figure 1G:
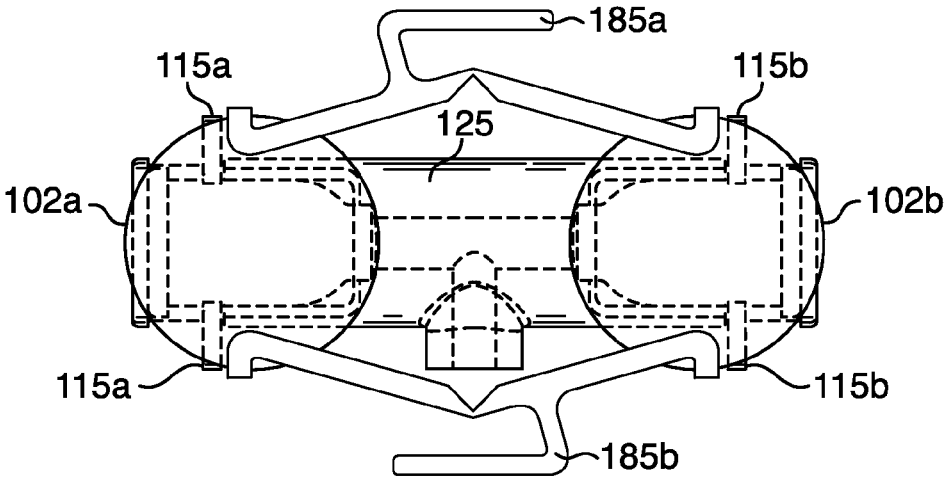
Figure 1H:
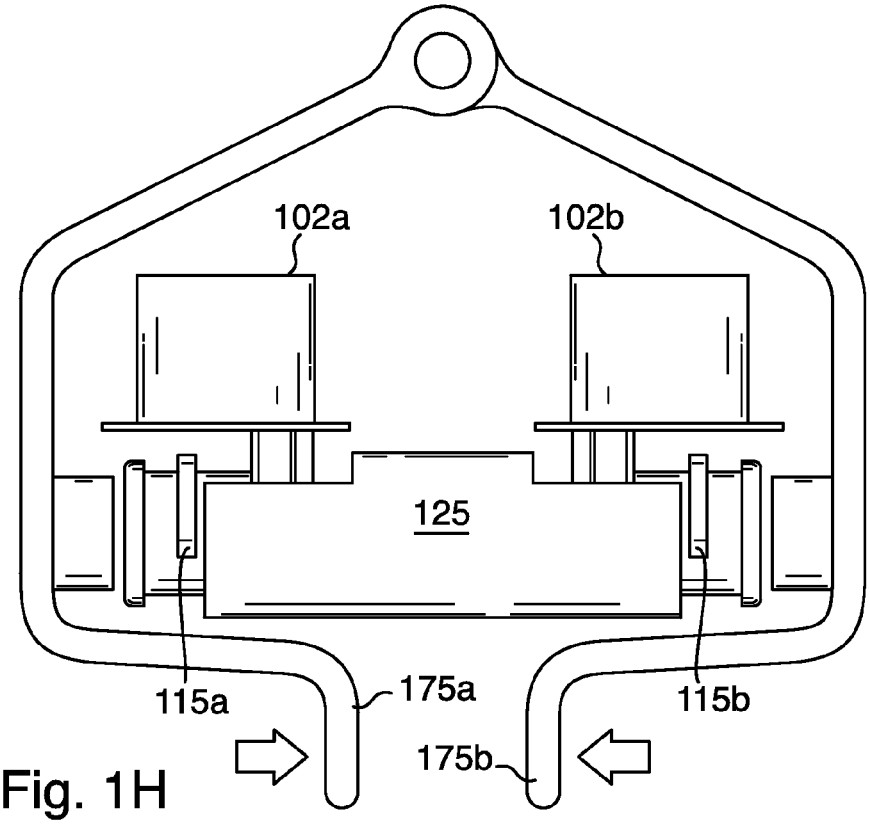
Figure 1I:
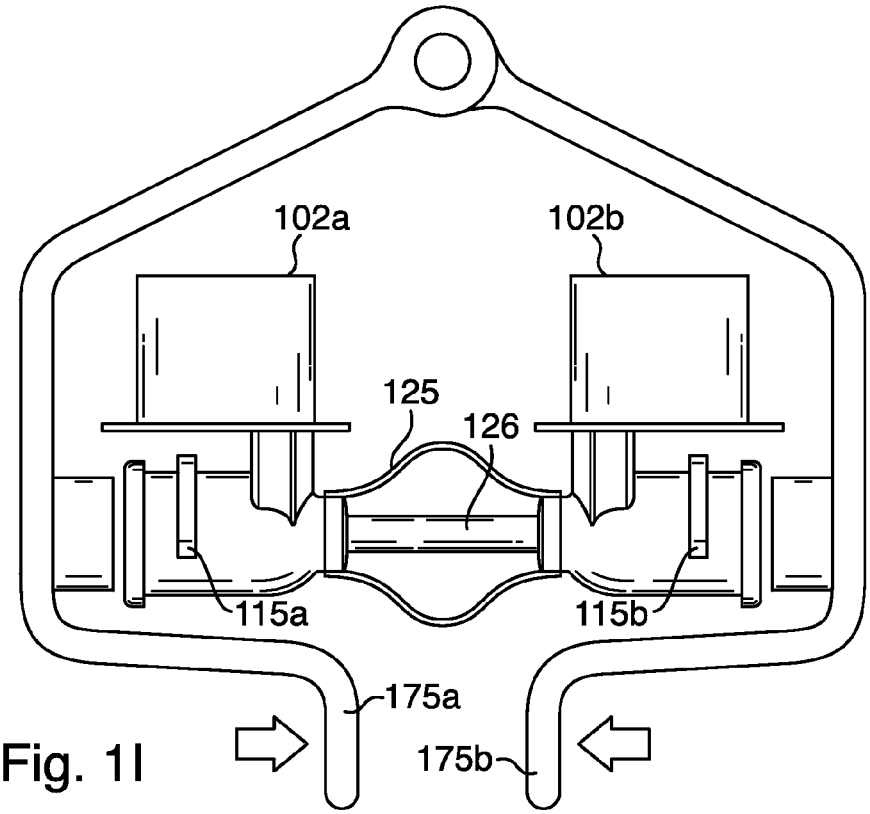

For instance, FIG. 1F illustrates one means for mechanically applying the counter-biasing force to the first and second taps wherein the first and second counter-biasing members are simple mechanical levers. In particular, the levers of FIG. 1F are class 1 levers. As shown in FIGS. 1H and 1I class 2 levers may be used instead. Even a class 3 lever is illustrated in FIG. 1G in the context of a cross-sectional view of a flexible U-shaped member that may be clipped around body 125 that has a living hinge that acts as the fulcrum for both of the disclosed levers. Force is input into the left-hand lever via the front flange 185*a*. It is likely that force will be input into the right-hand lever via the front flange 185*b* at the same time force is applied to flange 185*a*, the application of both manual forces will cause the actuator flanges on the body 125, which in FIG. 1H is also the counter-biasing member to push against the first and second actuators of taps 102*a* and 102*b*, respectively counter-biasing them to allow fluid flow between the first and second liquid sources and the dispensing spout.

Returning to FIGS. 1H and 1I, these illustrative embodiments not only disclose the use of levers but also illustrate a first counter-biasing member having a first portion physically disposed in operable association with the first valve member such that relative displacement between the first portion of the first counter-biasing member and the first tap causes the application of the counter-biasing force on the first valve member. In particular in FIG. 1H, a counter-biasing member (body 125) in placed operable association with the first force member 175*a* such that a force applied to the first force member (as shown by the broad arrow) is proportionally transferred to the counter-biasing member. In turn, the first force member causes tap 102*a* to physically move toward the right side of the page. Because of the substantially stationary mounting of both taps 102*a* and 102*b*, the non-deformable construction of the spacer 125 (as well as application of force via the second force member 175*b*), the spacer 125 will apply a counter-biasing force against actuators 115*a* and 115*b*. As would be understood by those of ordinary skill in the art, the arrangements illustrated in FIGS. 1H and 1I illustrate a system wherein the work done by each lever is balanced by the operation of the matching opposed forces in this substantially closed-mechanical system.

Another similar approach is illustrated in FIG. 1I where a rigid rod 126, i.e., the counter-biasing member is inserted in the first tap spout pressing against the first valve member and in the second tap spout pressing against the second valve member. The rigid rod 126 should have a diameter smaller than a diameter of the first and second tap spouts so as not to significantly impede the flow of liquid out of the taps during actuation. When force is introduced into the system via the first (and second) force members those forces causes the taps 102*a* and 102*b* to move substantially laterally toward one another, which in turn causes the rigid rod 126 to press against the face of the valve members in each tap counter-biasing each against the internal biases of the valves such that the valves open allowing the flow of liquids from the respective bags.

Figure 1J:
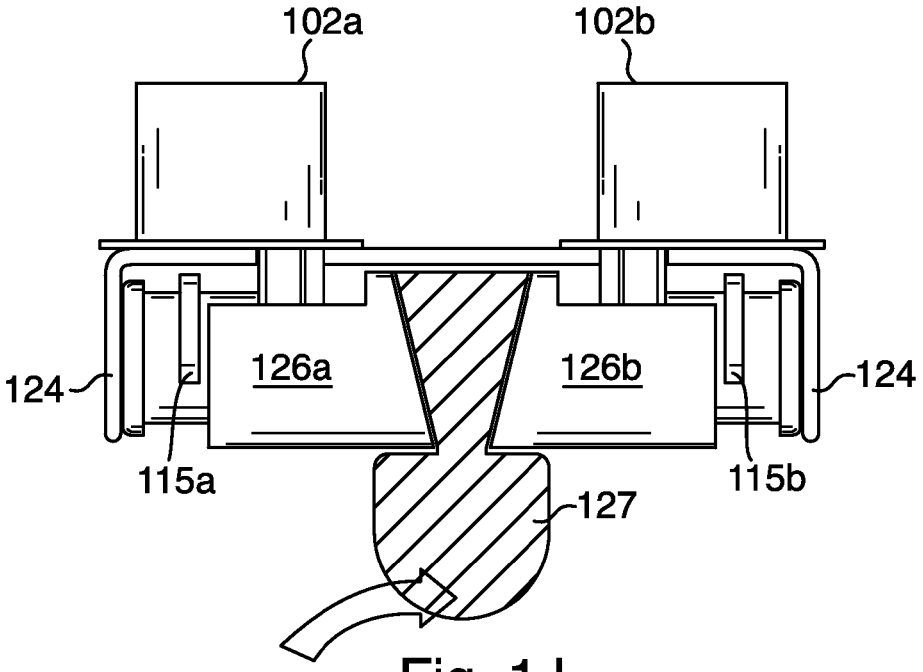

FIG. 1J illustrates a means for mechanically applying the counter-biasing force to the first and second taps 102*a* and 102*b* that involves a mechanical cam-cam follower arrangement. In particular human force may be applied downward on the finger tab 127, which is illustrated as being integral to a mechanical cam. As such, when the finger tab 127 is rotated the cam surfaces glide over the cam follower surfaces of the first and second counter-biasing members 126*a* and 126*b* forcing them to be displaced laterally, which in turn will force the actuators to be moved thus counter-biasing the respective valve members open. Frame 124 is positioned around the first and second taps 102*a* and 102*b* to substantially preclude relative movement of the first and second taps 102*a* and 102*b* when the counter-biasing force is being mechanically applied to the first and second taps 102*a* and 102*b*.

Figure 1K:
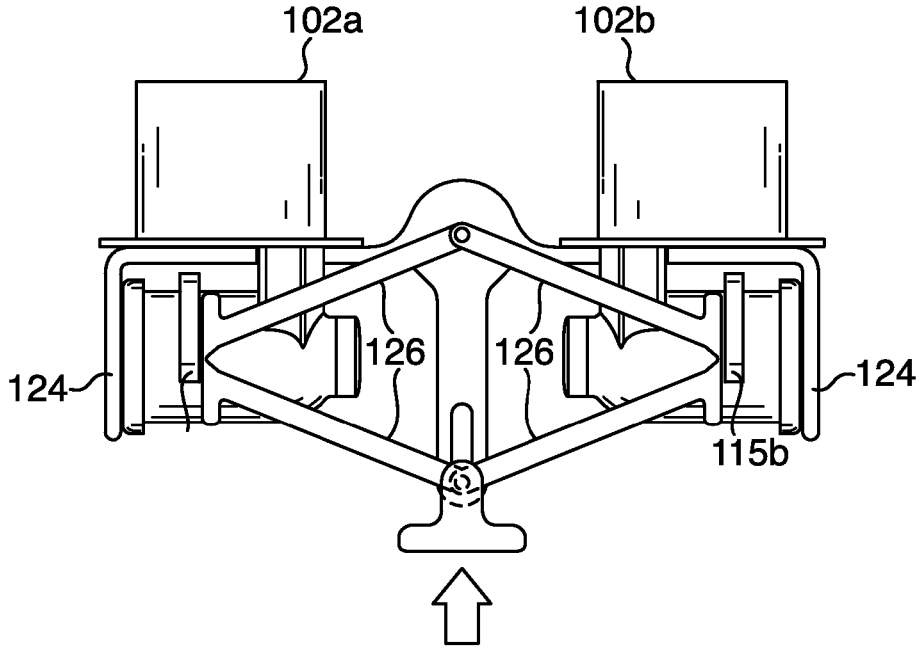
Figure 1L:
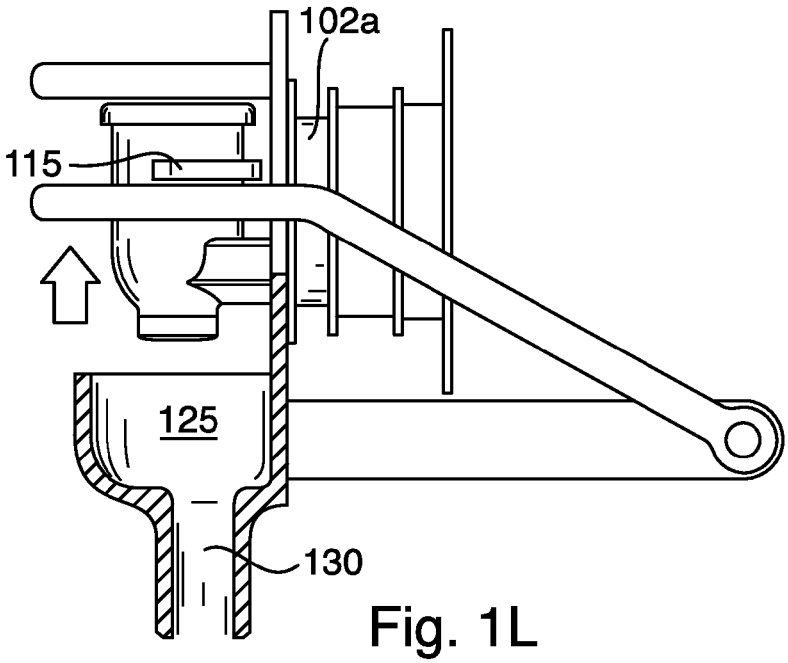
Figure 1M:
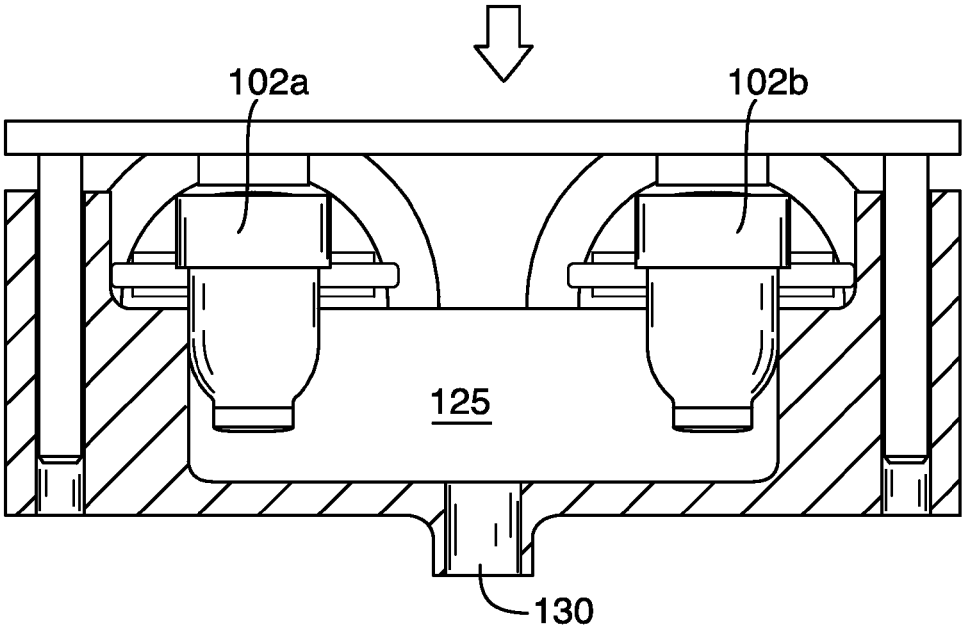
Figure 1N:
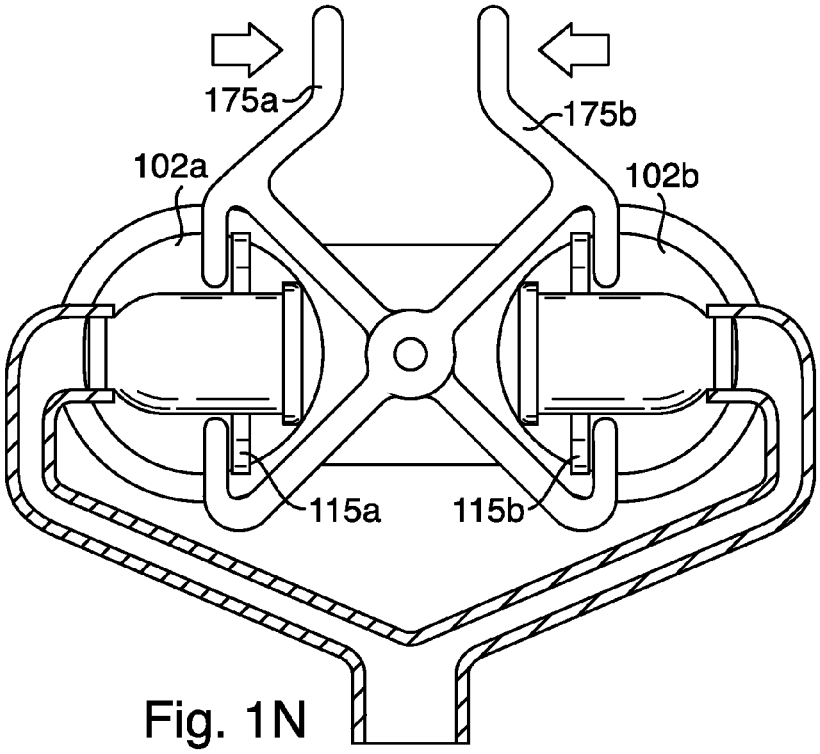

FIG. 1K is another illustration of a means for mechanically applying the counter-biasing force to the first and second taps that involves the application of a four bar linkage 126, a type of simple mechanical machine that utilizes some of the features of levers to apply forces of desired strength. Frame 124 is positioned around the first and second taps 102*a* and 102*b* to substantially preclude relative movement of the first and second taps 102*a* and 102*b* when the counter-biasing force is being mechanically applied to the first and second taps 102*a* and 102*b*. FIGS. 1L and 1M illustrate two potential arrangements of the taps in a vertical orientation. In FIG. 1L a clamp system (another class 2 lever) is used to actuate both taps 102*a* and 102*b* (not shown) to dispense the first and second liquids evenly into a collector body for mixing the liquids for dispensing via a dispensing spout. In FIG. 1M, a press system is used to press downward simultaneously on taps 102*a* and 102*b* that have end button actuators to dispense the first and second liquids evenly into a collector body for mixing the liquids for dispensing via a dispensing spout.

FIG. 1N illustrates yet another means for mechanically applying the counter-biasing force to the first and second taps. Another type of lever system is illustrated again where human force is applied as shown by the arrows to cause the first and second force member to grab onto the actuator wings of taps 102*a* and 102*b* to counter-bias them against the internal bias of the taps to open the valve member toward dispensing the first and second liquids into body 125 that at least partially mixes the liquids for dispensing via the dispensing spout.

Figure 1O:
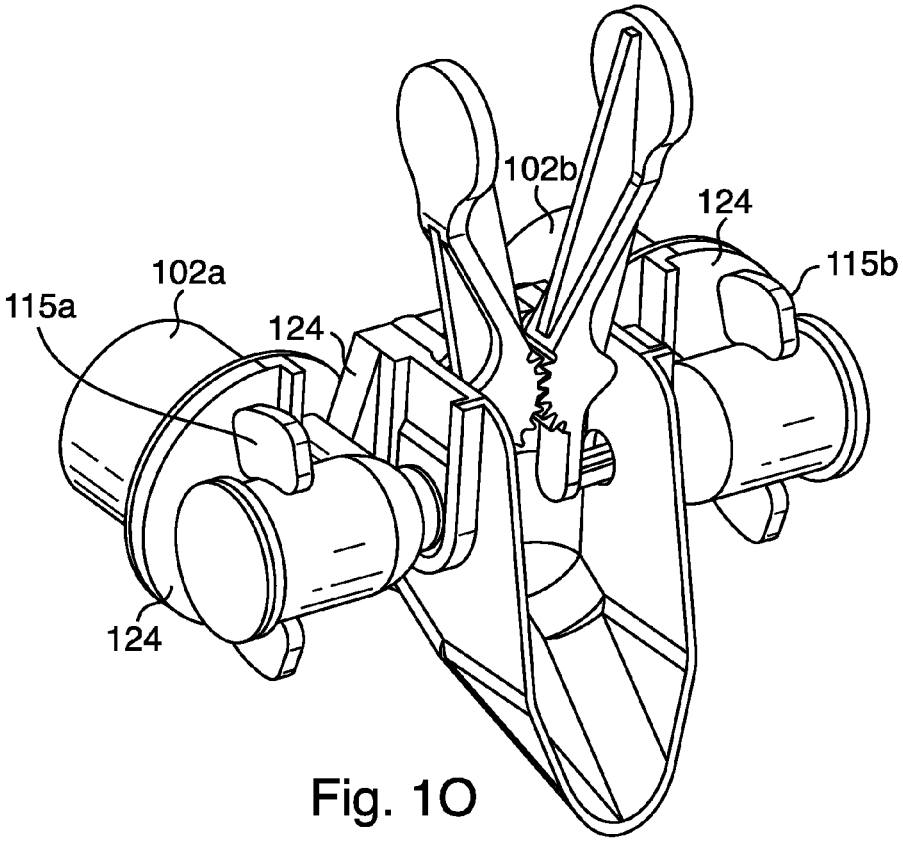

FIG. 1O illustrates another means for mechanically applying the counter-biasing force to the first and second taps. Here, two levers each rotate about independent fulcrums to force independent rigid rods 126 having diameters smaller than diameters of the respective tap spouts into the taps to apply counter-biasing forces directed against the respective valve members toward opening each against the internal bias of the taps. As illustrated each lever has cogs that ensure that both taps 102*a* and 102*b* are symmetrically displaced at any point in time during the manual actuation. The liquid that is released by each tap in response to the force flows into the gutter (a type of body) where it is mixed before the liquid spills down the dispensing spout. Also shown in FIG. 1O is a frame 124 positioned around the first and second taps to substantially preclude relative movement of the first and second taps when the counter-biasing force is being mechanically applied to the first and second taps.

Figure 2A:
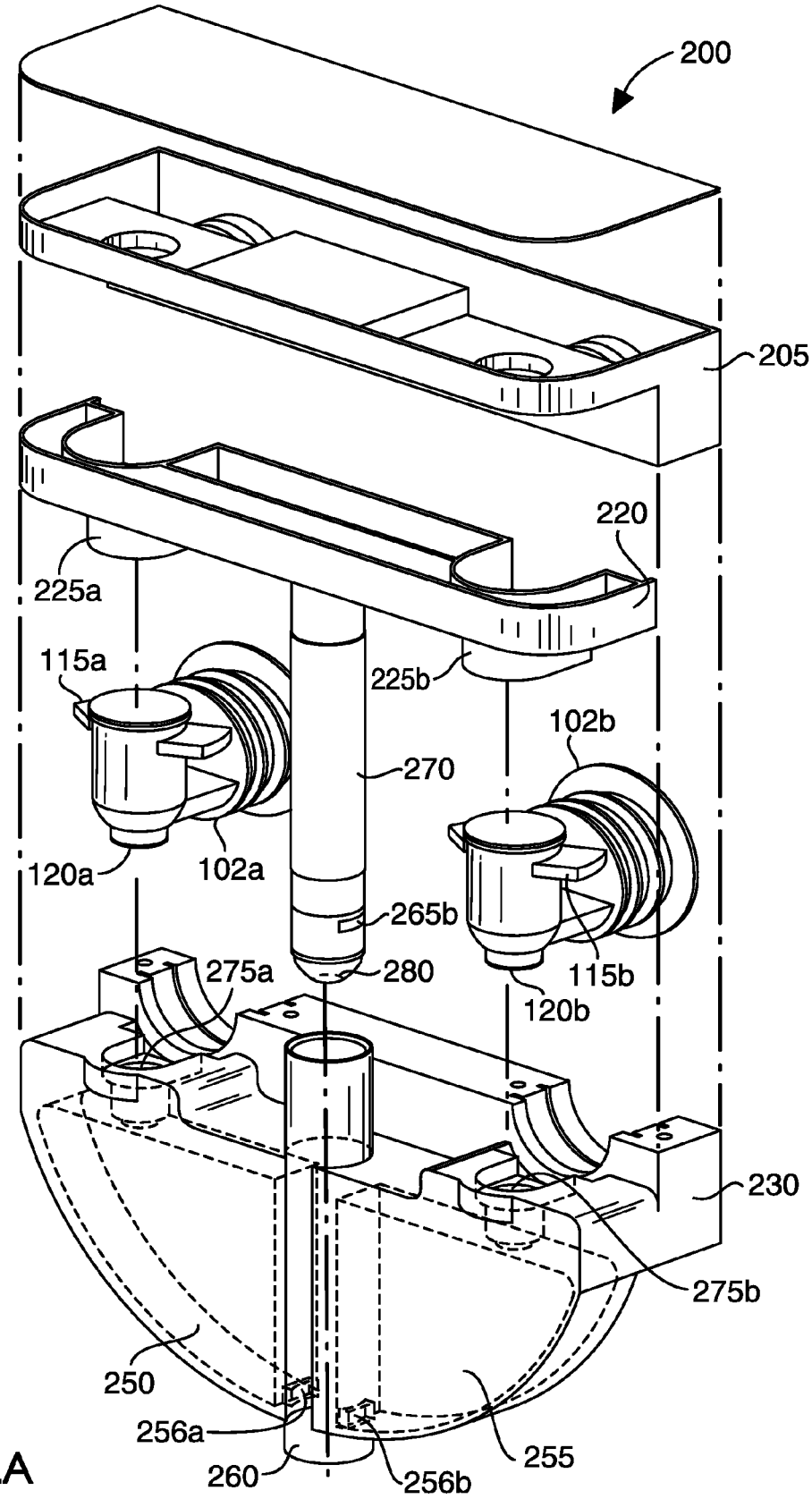
FIGS. 2A-2D illustrate another potential adaptor device for dispensing a plurality of liquids from a plurality of liquid sources, where a ratio other than 1:1 is desired.

FIG. 2A shows an exploded view of adaptor 200 around first tap 102*a* and second tap 102*b*. As before, each tap 102 is operably connected to a liquid sources and has a tap spout 120, an actuator 115, and a first valve member (not visible) that prevents fluid flow from the liquid source to the tap spout 120 unless the first actuator is biased downward by a linear force. Adaptor 200 includes a dispensing aperture 260. Adaptor 200 has a body 230 with a first chamber 250 in fluid communication with the tap spout 120*a* via aperture 275*a* and a second chamber 255 in fluid communication with the tap spout 120*b* via aperture 275*b*. As best seen in FIG. 2A, the first and second chambers 250, 255 are both in fluid communication with the dispensing spout 260 via slots 256*a* and 256*b*, respectively. Adaptor 200 further includes first member 220 slidably mounted over the body 230 and dispensing aperture 260. The first member 220 having a front flange 221 and actuator flanges 225*a* and 225*b*. The actuator flanges 225*a* and 225*b* are disposed in an abutting relationship with the actuators 115*a* and 115*b*, respectively.

Figure 2B:
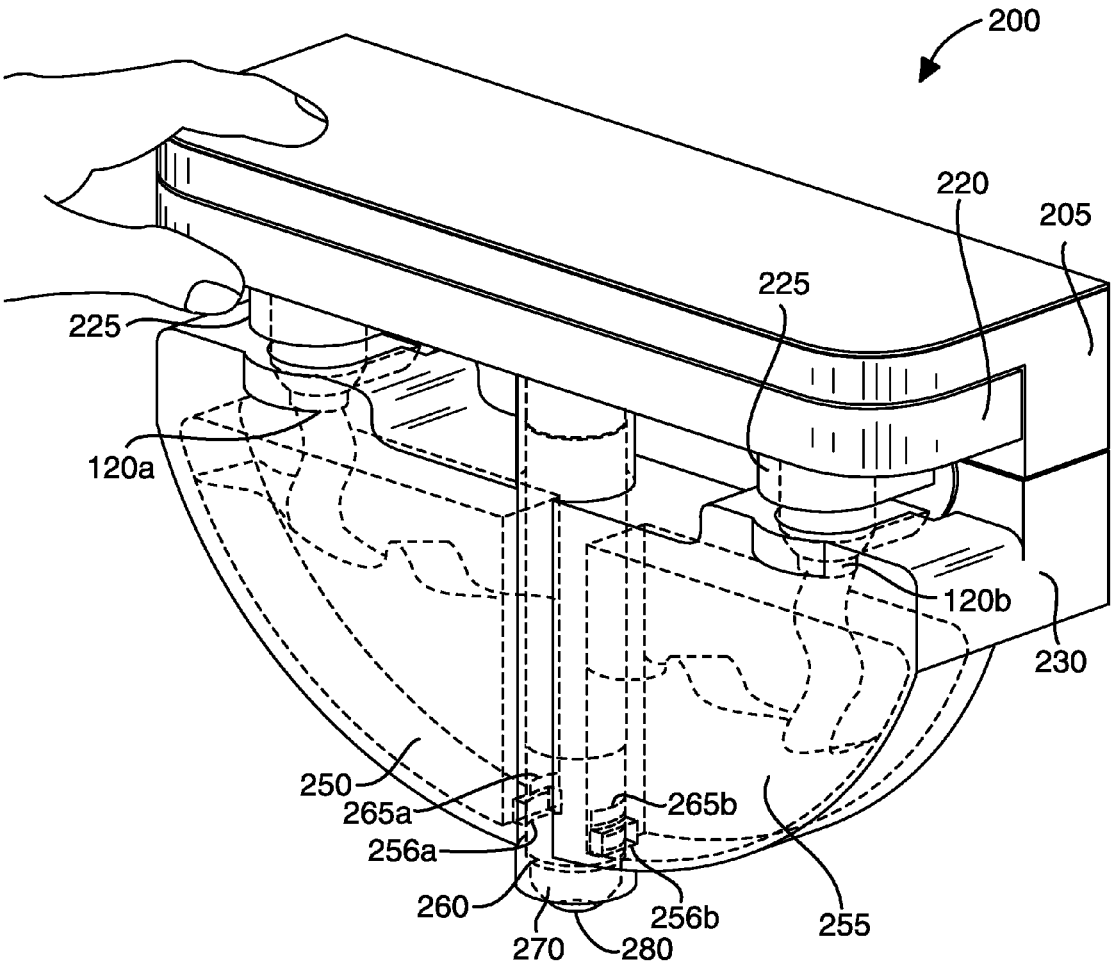
Figure 2C:
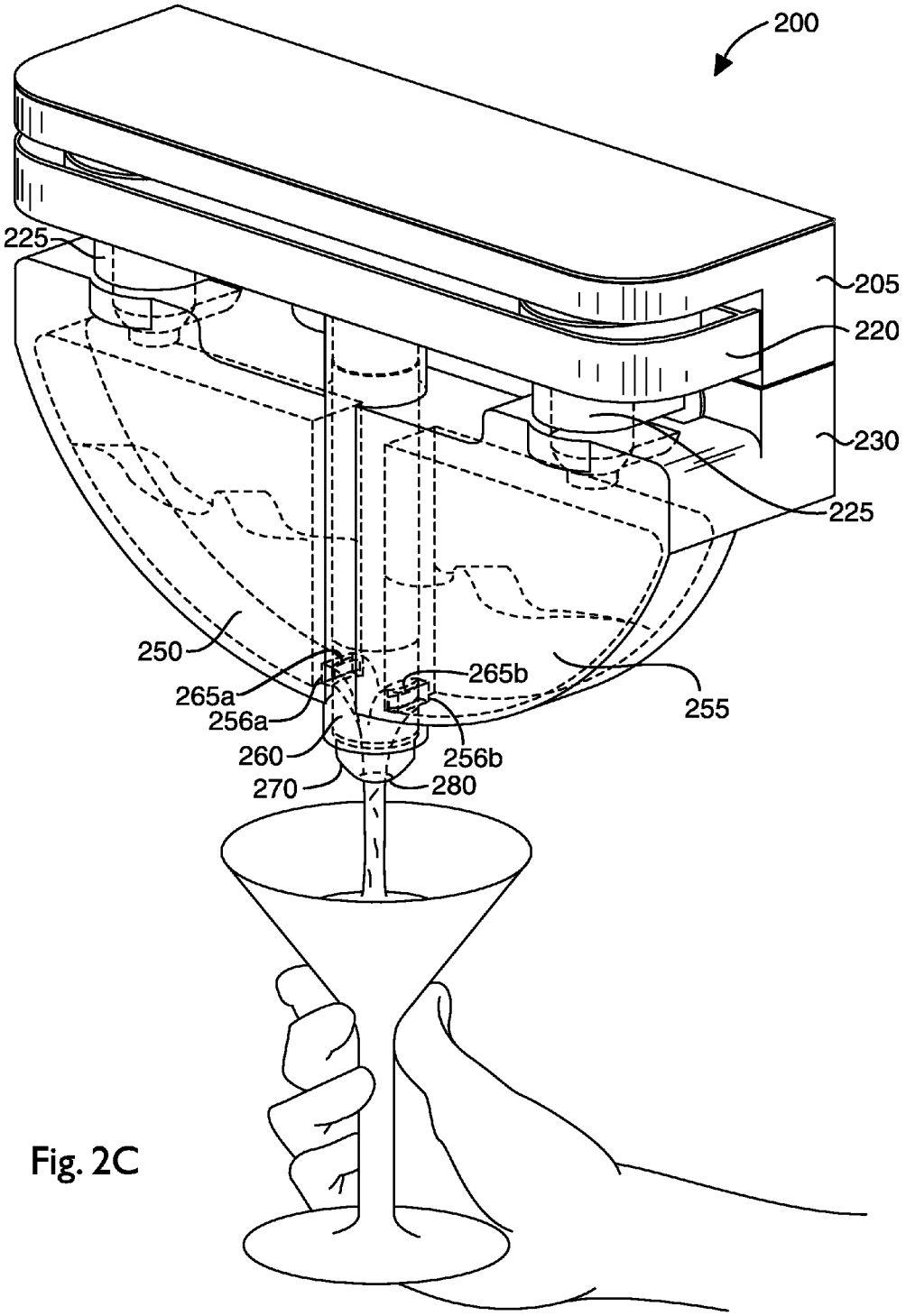
Figure 2D:
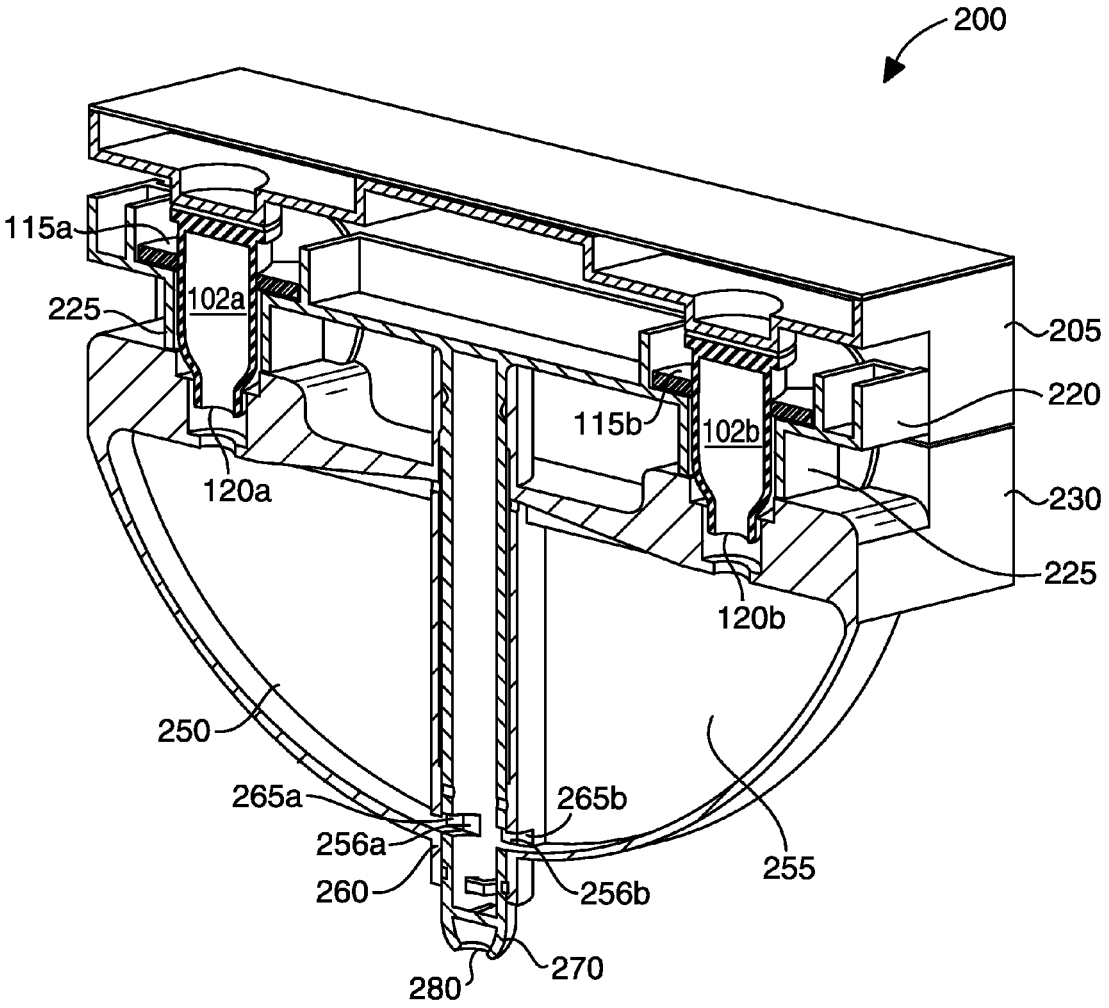
Figure 3A:
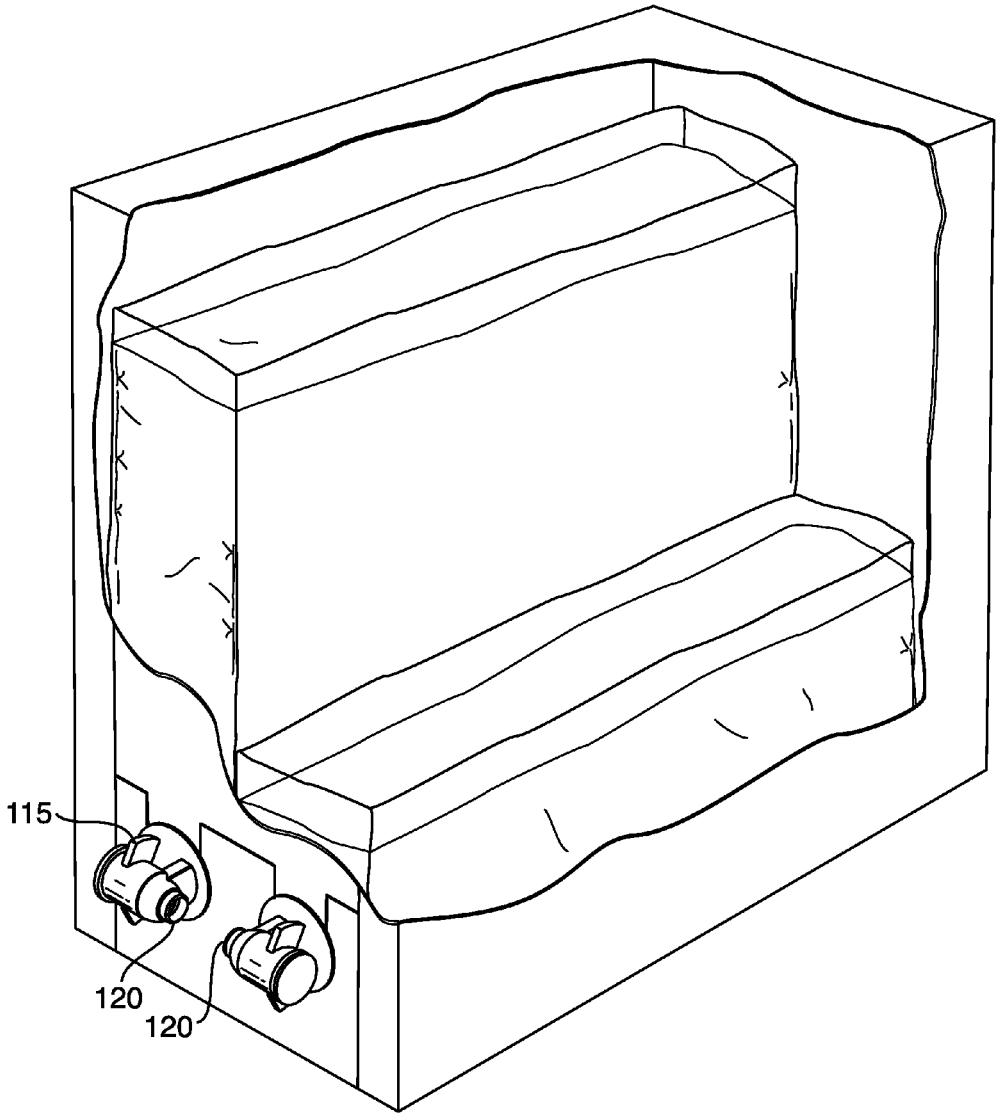
FIGS. 3A-3E illustrate one potential use of the adaptor device of FIGS. 1A-1D, showing a bag-in-a-box having two bags with different liquids and the dispensing of a mixed drink into a glass.
Figure 3B:
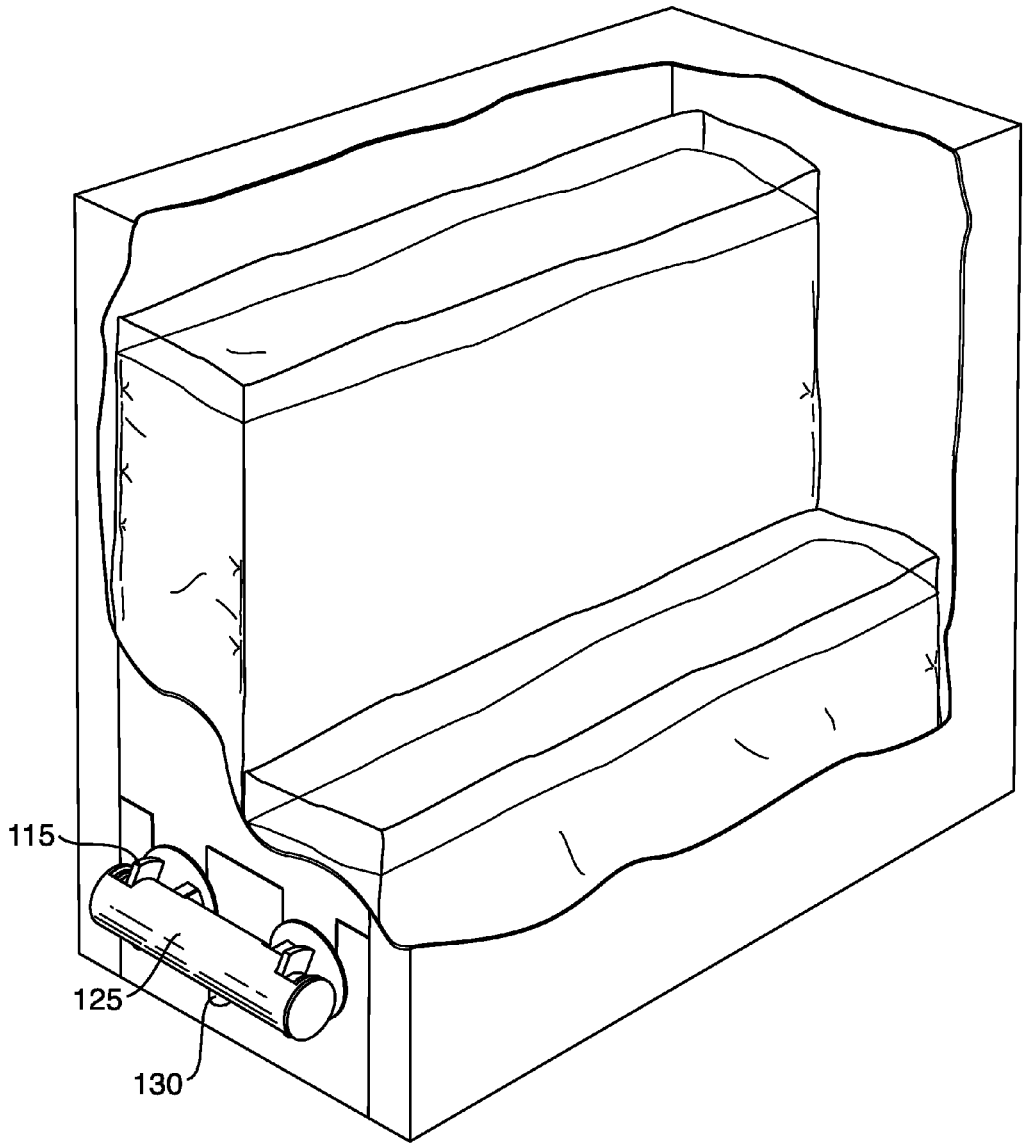
Figure 3C:
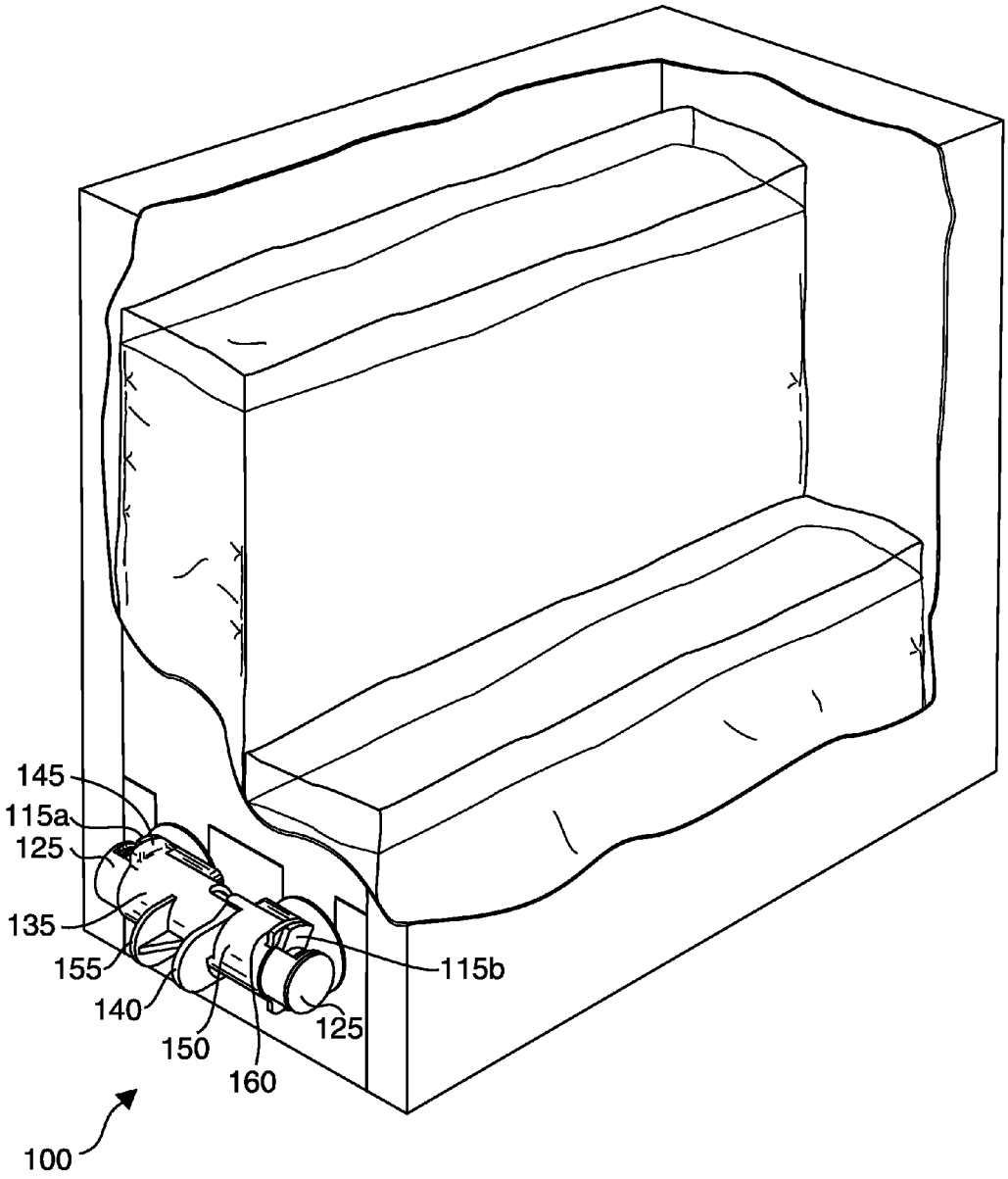
Figure 3D:
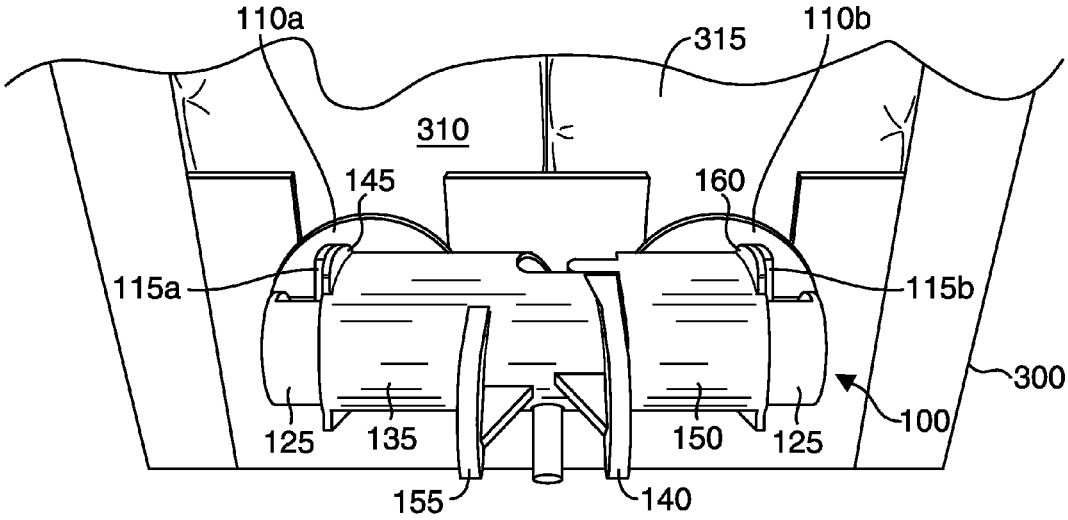
Figure 3E:
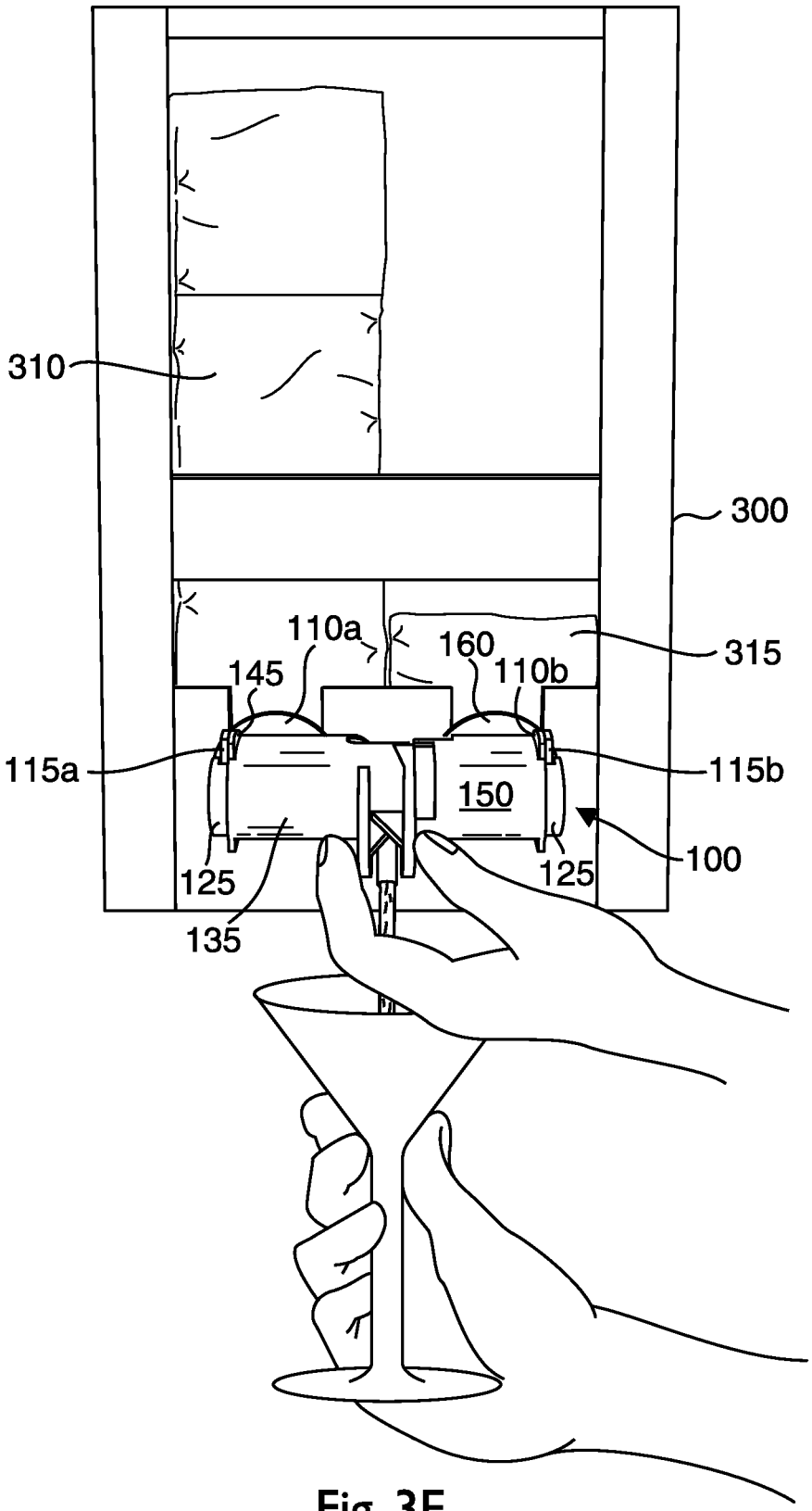

As best shown in FIGS. 2D and 2E, stem 270 has an internal fluid channel with an exit 280 at the end of the internal fluid channel and first aperture 265*a* and second aperture 265*b*. As illustrated both the first and second apertures 265 are preferably equally spaced-apart from the exit 280 and operably connected thereto. As illustrated in FIG. 2A, in operation the stem 270 is disposed in the dispensing spout 260. The stem 270 is also rigidly connected to the first member 220 such that the stem 270 moves up and down in the dispensing spout such that the first and second apertures 265*a*, 265*b* are only in fluid registration with the first and second chambers 250, 255 when respective slots 256*a*, 256*b* via the slots in the dispensing spout when the first member 220 is at rest (see FIGS. 2C and 2E).

The adaptor 200 finally includes a second member 205 mounted over the first member 220, body 230, dispensing spout 260 and stem 270 completing the assembly of the adaptor 200, such that the front flange of the first member 220 may be pinched together with the second member 205 (as illustrated with fingers in FIG. 2B) resulting in the actuator flanges 225*a* and 225*b* of the first member biasing the first and second actuators 115*a* and 115*b*, respectively, with the linear force necessary to allow fluid flow from the first and second liquid sources through the first and second tap spouts 120*a* and 120*b* and into the first chamber 250 and second chamber 255, respectively. When first member 220 is released, the actuators 115 of the taps cause the first member 220 to return toward its rest position (illustrated in FIG. 2C), causing the first and second apertures 265*a* and 265*b* on stem 270 to be aligned with the slots 256*a* and 256*b*, thus, allowing the fluids that had been temporarily stored in the first chamber 250 and the second chamber 255 to flow out of adaptor 200 via the internal channel of stem 270 and through the dispensing spout 260.

As illustrated in FIG. 2A, the adaptor 200 may be attached to the taps 102 by snapping elements 205, 220, 230 together. The connection can also be made by any friction fit.

In the example where two bags containing different liquid components of a drink are employed, there would be two chambers 250, 255. The chambers 250, 255 may have the same or different volumes. The chambers 250 and 255 will particularly have different volumes where the adaptor 200 is intended for use in making a mixed beverage where different amount of the two liquids are desired. For example, where the desired ratio of one liquid to the other is 2:1 the ratio of the volumes of the chambers 250 and 255 would also be 2:1.

As the taps 102 are opened by the action of pinching the second element 220 toward the first element 205, first and second liquids flow into respective first and second chambers 250, 255 until each is filled. The flow of liquids into each chamber may be controlled in several ways. First, the liquid flow paths may be of different diameters to adjust the fluid flow rates. Second, a float (or other type of) valve may be added between the top of the chamber and the tap to preclude additional liquid from flowing into the associated chamber once the chamber is already filled.

FIGS. 3A, 3B, 3C, and 3D, illustrate the adaptor 100 in place on a bag-in-box container 300. The taps 102*a* and 102*b* associated with the container 300 are operably connected to a respective one of the two bags/pouches 310 and 315 within container. It is contemplated that the number of bags may be greater than two, with the adaptor 100 being altered accordingly, so that three or more taps can be actuated by an adaptor configured to attach to three or more bags. It is contemplated that the bags/pouches may be disposed in a tray or even sold without any supporting or protective container. The bags/pouches 310, 315 may hold a variety of liquids. In one aspect, the bags may hold two components for a mixed drink or cocktail, where the ingredients are desirably mixed in substantially equal amounts. For example, bag 310 may hold rum and bag 315 may hold a liquid daiquiri mixer. When the front flanges 140 and 155 of adaptor 100 are pinched together the actuators 115*a*, 115*b* of each tap 102*a*, 102*b* are actuated by pressure, allowing both bags 310 and 315 to dispense equal amounts of their respective liquids, which are mixed upon release to concoct a perfect cocktail.

Figure 4A:
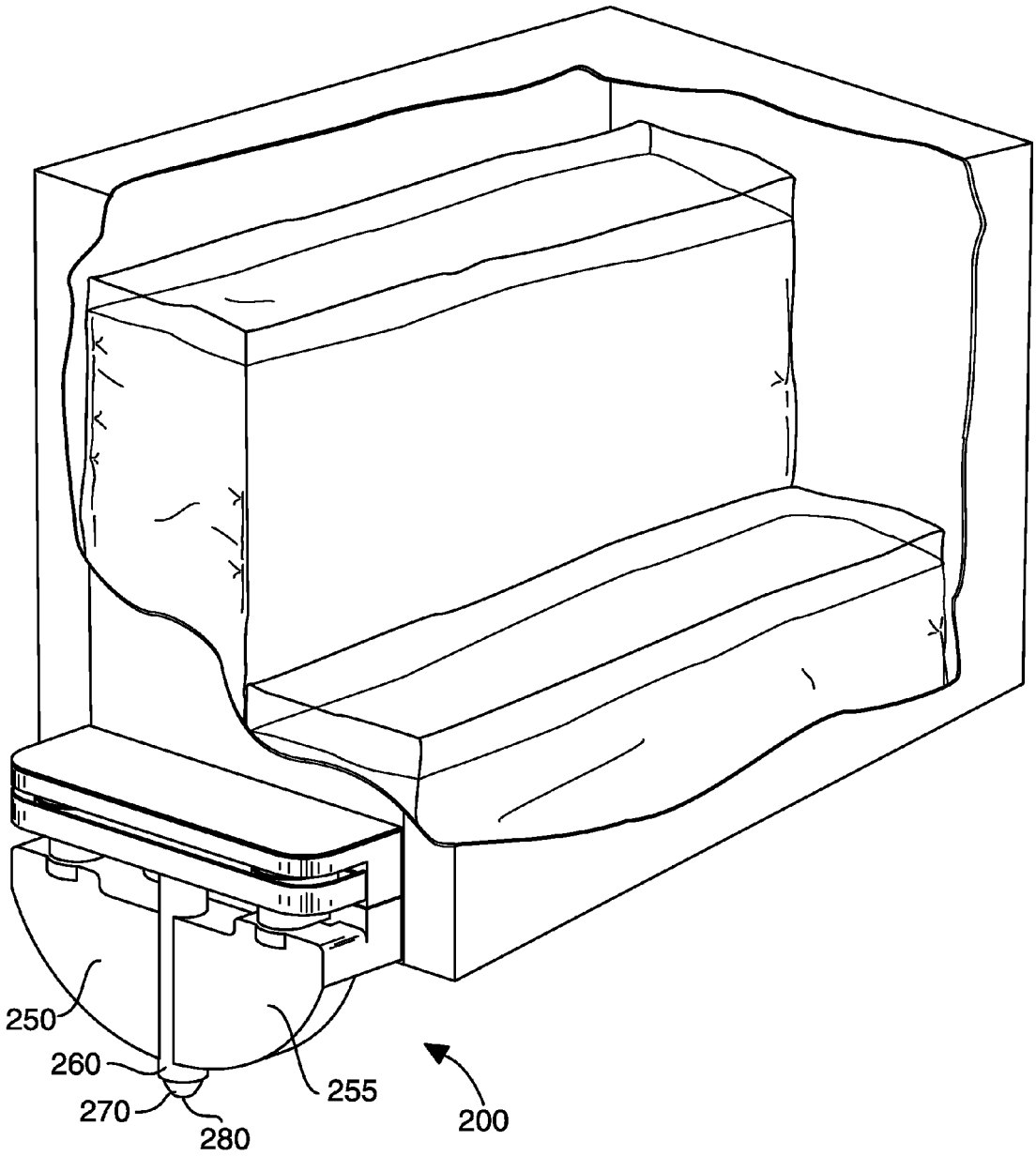
FIGS. 4A-4C illustrate one potential use of the adaptor device of FIGS. 2A-2D, showing a bag-in-a-box having two bags with different liquids, including showing the dispensing of a mixed drink into a glass.
Figure 4B:
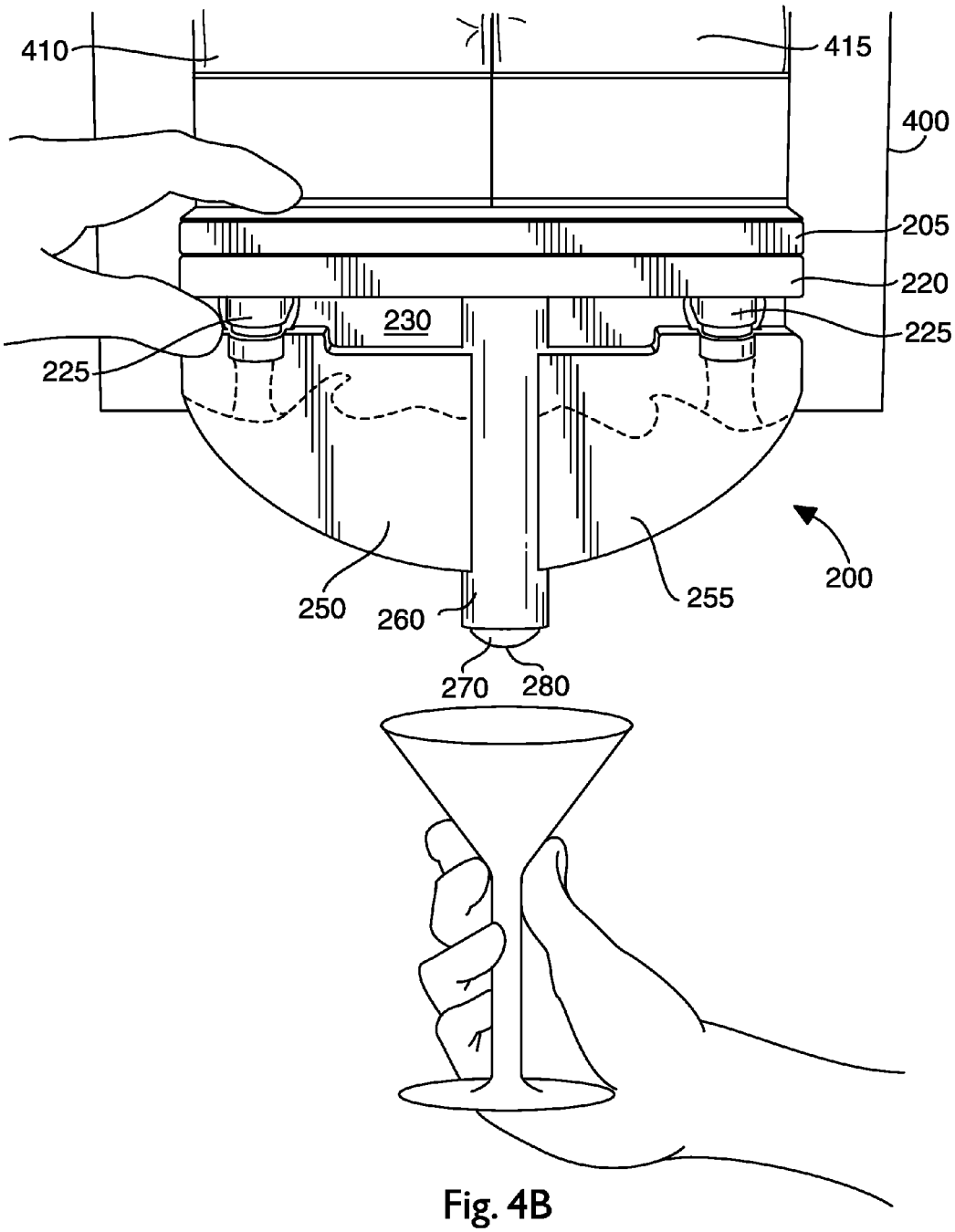
Figure 4C:
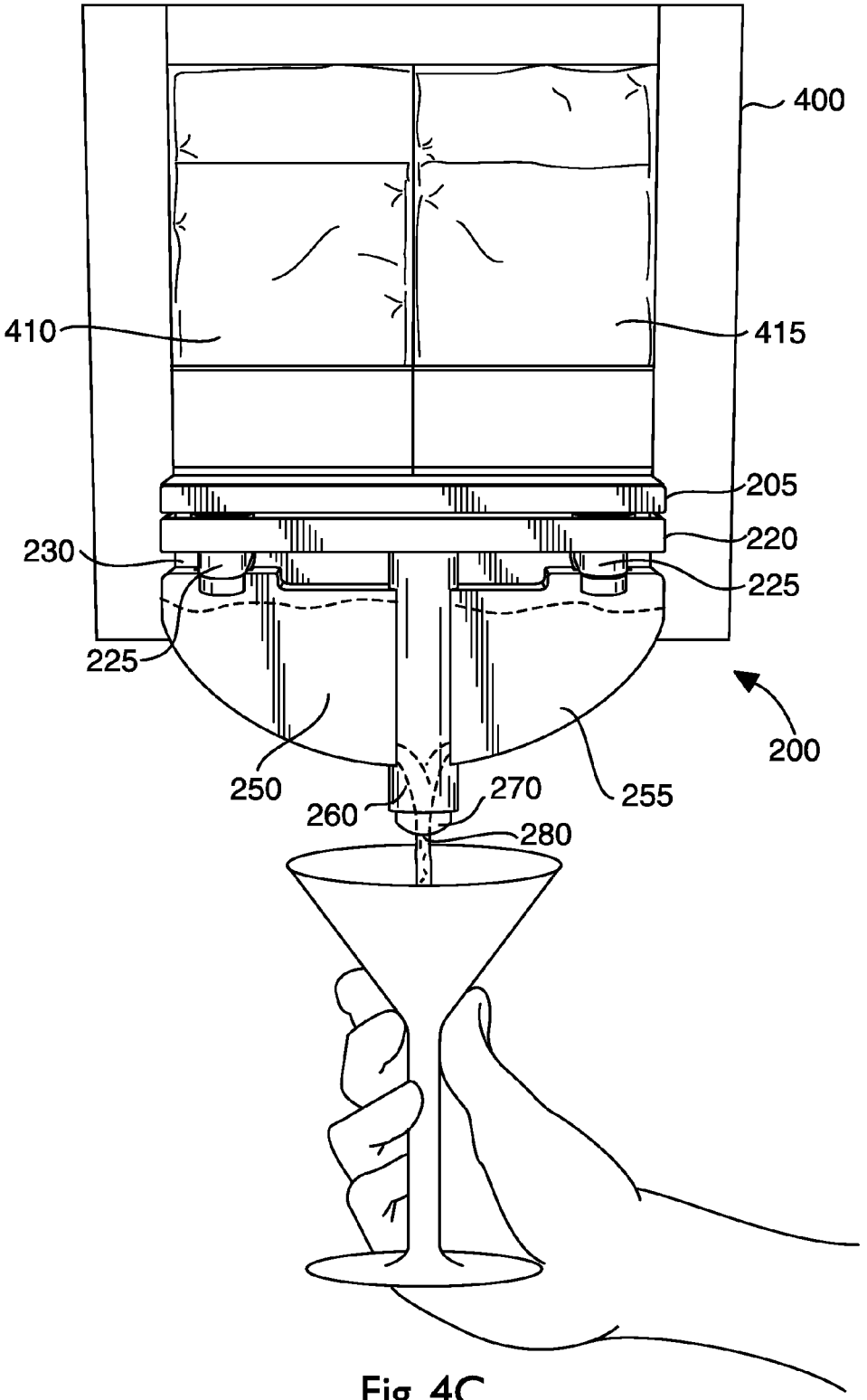

FIGS. 4A, 4B, and 4C illustrate adaptor 200 in place on a bag-in-box container 400. The taps 102 (not shown) of container 400 are operably connected to a respective one of the two bags 410, 415 in the container. It is contemplated that the bags/pouches may be disposed in a tray or even sold without any supporting or protective container. It is also contemplated that the number of bags may be greater than two, with the adaptor 200 being altered accordingly, so that three or more taps can be actuated by an adaptor configured to attach to three or more bags. The bags 410, 415 may hold a variety of liquids. In one aspect, the bags can hold two components for a mixed drink or cocktail, where the ingredients have different densities or are required in different amounts. For example, one bag 410 may hold rum and bag 415 may hold orange juice such that when the liquids are mixed together a rum and juice drink is created. When the protrusions 115 (not shown in FIG. 4C) of each tap 102 (not shown in FIG. 4C) are actuated by element 220, both bags dispense the desired amount of liquid into the associated chamber, which are mixed upon release to concoct a perfect cocktail.

Liquids used in this invention may have significantly varying viscosities such that the first and second components may flow at significantly varying rates. It is contemplated that the viscosity of one or both of the liquids may be adjusted to achieve a better flow and/or more desirable mixing ratio. Where such approach is desired in consumable food stuffs, the viscosity may be adjusted through the addition of sugar (to increase the viscosity) or water (to decrease the viscosity). Where such an approach is undesirable or perhaps unachievable, adaptor 200 may be used in association with liquids of significantly varying viscosities and still achieve a substantially 1:1 ratio as would be understood by one of ordinary skill in the art having the present specification, drawings, and claims before them.

In this manner, a method of preparing a mixed drink is disclosed wherein the consumers acquire a container that has first and second liquid bags disposed therein with the first liquid hag storing a first liquid and the second liquid bag storing a second liquid. The acquired container would have a first tap operably connected to the first liquid bag and a second tap operably connected to the second liquid bag with both taps having a tap spout, an actuator, and a valve member that prevents fluid flow from the associated liquid bag to the tap spout unless the actuator is biased by a linear force. The consumers may install an adaptor over the first and second taps, wherein the adaptor has a dispensing spout, a body in fluid communication with each of the first and second tap spouts and the dispensing spout, a first member slidably mounted over the body that has a front flange and an actuator flange disposed in an abutting relationship with the actuator of a respective one of the taps and a second member slidably mounted over the body that has a front flange and an actuator flange disposed in an abutting relationship with the actuator of another respective one of the taps, wherein the first and second members are slidably mounted with respect to one another such that when the front flanges of the first and second members are pinched together the actuator flanges bias the first and second actuators with the linear force necessary to allow fluid flow between the first and second liquid bags and the first and second tap spouts and into the adaptor body and out the dispensing spout. The method finally including receiving the mixed liquids into a vessel.

Similarly, a method of preparing a produced formed from the mixing of two components is disclosed wherein the consumers acquire first and second pouches with the first pouch storing a first component and the second pouch storing a second component. A first tap is operably connected to the first pouch and a second tap is operably connected to the second pouch with both taps having a tap spout, an actuator, and a valve member that prevents the component from flowing from the associated pouch to the tap spout unless the actuator is biased by a linear force. The consumers may install an adaptor over the first and second taps, wherein the adaptor has a dispensing spout, a body in fluid communication with each of the first and second tap spouts and the dispensing spout, a first member slidably mounted over the body that has a front flange and an actuator flange disposed in an abutting relationship with the actuator of a respective one of the taps and a second member slidably mounted over the body that has a front flange and an actuator flange disposed in an abutting relationship with the actuator of another respective one of the taps, wherein the first and second members are slidably mounted with respect to one another such that when the front flanges of the first and second members are pinched together the actuator flanges bias the first and second actuators with the linear force necessary to allow fluid flow between the first and second liquid bags and the first and second tap spouts and into the adaptor body and out the dispensing spout. The method finally including receiving the mixed liquids into a vessel.

The foregoing description and drawings merely explain and illustrate the invention and the invention is not limited thereto. While the specification in this invention is described in relation to certain implementation or embodiments, many details are set forth for the purpose of illustration. Thus, the foregoing merely illustrates the principles of the invention. For example, the invention may have other specific forms without departing from its spirit or essential characteristic. The described arrangements are illustrative and not restrictive. To those skilled in the art, the invention is susceptible to additional implementations or embodiments and certain of these details described in this application may be varied considerably without departing from the basic principles of the invention. It will thus be appreciated that those skilled in the art will be able to devise various arrangements, which, although not explicitly described or shown herein, embody the principles of the invention and, thus, are within its scope and spirit. All patents, patent application publications, and other publications are incorporated by reference in their entirety.

What is claimed is:

1. A system for dispensing a liquid sourced from a plurality of liquid sources comprising:

a first tap operably connected to a first one of the plurality of liquid sources, the first tap having a first tap spout, a first valve member biased closed so as to prevent fluid flow from the first liquid source to the first tap spout unless under a counter-biasing force, and a first actuator operably associated with the first valve member to apply the counter-biasing force;

a second tap operably connected to a second one of the plurality of liquid sources, the second tap having a second tap spout, a second valve member biased closed so as to prevent fluid flow from the second liquid source to the second tap spout unless under a counter-biasing force, and a second actuator operably associated with the second valve member to apply the counter-biasing force;

an adaptor having a dispensing spout and a body to communicate fluid between the dispensing spout and each of the first and second tap spouts; and means for mechanically applying the counter-biasing force to the first and second taps comprising:

a first counter-biasing member having front and actuator flanges, the first counter-biasing actuator flange being disposed in an abutting relationship with the first actuator; and a second counter-biasing member having front and actuator flanges, the second counter-biasing actuator flange being disposed in an abutting relationship with the second actuator such that when the front flanges of the first and second counter-biasing members are pinched together the actuator flanges of the first and second counter-biasing members push against the first and second actuators counter-biasing them to allow fluid flow between the first and second liquid sources and the first and second tap spouts.

2. The system of claim 1 wherein the body further comprises a frame positioned around the first and second taps to substantially preclude relative movement of the first and second taps when the counter-biasing force is being mechanically applied to the first and second taps.

3. The system of claim 1 wherein the first and second counter-biasing members are slidably mounted on the body.

4. The system of claim 1 wherein the first and second counter-biasing members are simple mechanical levers.

5. The system of claim 1, wherein both the first and second tap spouts are oriented so as to discharge liquid toward one another in a substantially longitudinal orientation.

6. The system of claim 1, wherein liquids from the first and second liquid sources are at least partially mixed together in a 1:1 ratio in the body of the adaptor.

7. An adaptor for operably associating first and second taps respectively connected to first and second liquid sources, the first tap having a first tap spout, a first valve member biased closed so as to prevent fluid flow from the first liquid source to the first tap spout unless under a counter-biasing force, and a first actuator operably associated with the first valve member to apply the counter-biasing force, the second tap having a second tap spout, a second valve member biased closed so as to prevent fluid flow from the second liquid source to the second tap spout unless under a counter-biasing force, and a second actuator operably associated with the second valve member to apply the counter-biasing force, the adaptor comprising:

a dispensing aperture;

a body in fluid communication with each of the first and second tap spouts and the dispensing aperture wherein the liquids from the first and second liquid sources are at least partially mixed together in the body; and means for mechanically applying the counter-biasing force to the first and second taps comprising:

a first counter-biasing member having front and actuator flanges, the first counter-biasing actuator flange being disposed in an abutting relationship with the first actuator; and a second counter-biasing member having front and actuator flanges, the second counter-biasing actuator flange being disposed in an abutting relationship with the second actuator such that when the front flanges of the first and second counter-biasing members are pinched together the actuator flanges of the first and second counter-biasing members push against the first and second actuators counter-biasing them to allow fluid flow between the first and second liquid sources and the first and second tap spouts.

8. The adaptor of claim 7 wherein the body further comprises a frame positioned around the first and second taps to substantially preclude relative movement of the first and second taps when the counter-biasing force is being mechanically applied to the first and second taps.

9. The adaptor of claim 7 wherein the first and second counter-biasing members are slidably mounted on the body.

10. The adaptor of claim 7 wherein the first and second counter-biasing members are simple mechanical levers.

11. A system for dispensing a liquid comprising:

a container;

a first liquid bag disposed within the container, the first liquid bag storing a first liquid;

a second liquid bag disposed within the container, the second liquid bag storing a second liquid;

a first tap operably connected to the first liquid bag, the first tap having a first tap spout, a first valve member biased closed so as to prevent fluid flow from the first liquid bag to the first tap spout unless under a counter-biasing force, and a first actuator operably associated with the first valve member to apply the counter-biasing force;

a second tap operably connected to the second liquid bag, the second tap having a second tap spout, a second valve member biased closed so as to prevent fluid flow from the second liquid bag to the second tap spout unless under a counter-biasing force, and a second actuator operably associated with the second valve member to apply the counter-biasing force;

an adaptor having a dispensing aperture and a body in fluid communication with each of the first and second tap spouts and the dispensing aperture wherein the liquids from the first and second liquid bags are at least partially mixed together in the body; and means for mechanically applying the counter-biasing force to the first and second taps comprising:

a first counter-biasing member having front and actuator flanges, the first counter-biasing actuator flange being disposed in an abutting relationship with the first actuator; and a second counter-biasing member having front and actuator flanges, the second counter-biasing actuator flange being disposed in an abutting relationship with the second actuator such that when the front flanges of the first and second counter-biasing members are pinched together the actuator flanges of the first and second counter-biasing members push against the first and second actuators counter-biasing then to allow fluid flow between the first and second liquid bags and the first and second tap spouts.

12. The system of claim 11, wherein both the first and second tap spouts are oriented so as to discharge liquid toward one another in a substantially longitudinal orientation.

13. The system of claim 11 further comprising means for mechanically applying the counter-biasing force to the first and second taps.

* * * * *